United States Patent [19]

Demo, Jr.

[11] 3,992,198

[45] Nov. 16, 1976

[54] DUCTILE CHROM IUM-CONTAINING FERRITIC ALLOYS

[75] Inventor: Joseph J. Demo, Jr., Wilmington, Del.

[73] Assignee: E. I. Du Pont de Nemours & Company, Wilmington, Del.

[22] Filed: May 7, 1975

[21] Appl. No.: 575,403

Related U.S. Application Data

[63] Continuation of Ser. No. 371,951, June 21, 1975, abandoned, which is a continuation-in-part of Ser. No. 153,259, June 15, 1971, abandoned, which is a continuation-in-part of Ser. Nos. 51,283, June 30, 1970, abandoned, and Ser. No. 886,620, Dec. 19, 1969, abandoned, and Ser. No. 847,296, Aug. 4, 1969, abandoned.

[52] U.S. Cl. ..... 75/124; 75/126 C; 75/126 D; 75/126 J; 148/37

[51] Int. Cl.[2] ..... C22C 38/28

[58] Field of Search ..... 75/124, 126 C, 126 D, 75/126 J; 148/37

[56] References Cited

UNITED STATES PATENTS

| | | | |
|---|---|---|---|
| 1,508,032 | 2/1919 | Smith | 75/126 D X |
| 2,080,001 | 5/1937 | Becket et al. | 75/126 D X |
| 2,191,790 | 2/1940 | Franks | 75/124 X |
| 2,597,173 | 5/1952 | Patterson | 75/126 R |
| 2,624,671 | 1/1953 | Binder et al. | 75/126 R |
| 2,672,414 | 3/1954 | Phillips, et al. | 75/126 R |

OTHER PUBLICATIONS

Lula, et al., "Intergranular Corrosion of Ferritic Stainless Steels" 1954–ASM pp. 197–230.

*Primary Examiner*—Arthur J. Steiner

[57] ABSTRACT

Ferritic iron-chromium alloys containing 19–35 wt. per cent chromium inhibited against the embritling effects of C+N up to a combined total of about 0.28 weight per cent by inclusion of Ti together with A1.

11 Claims, 47 Drawing Figures

AS CHARGED

Figure 1A:
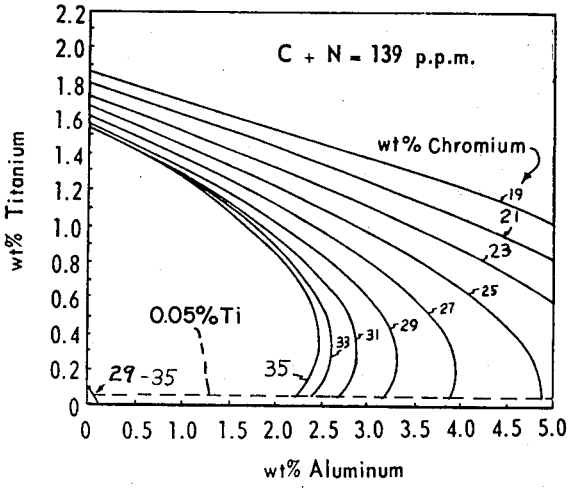
Figure 1B:
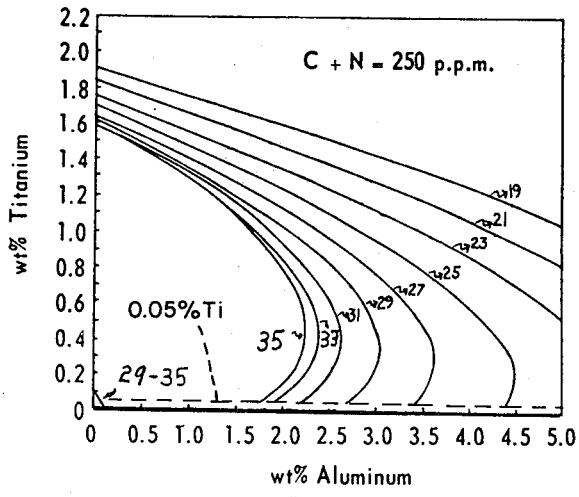

Iso-Chromium Plots Defining Alloys Having Post-Weld Ductility At, or Below, Room Temperature (75°) At Recited C + N Levels In P.P.M.

INVENTOR
Joseph J. Demo, Jr.

BY Harry J. McCauley
ATTORNEY

AS CHARGED

Iso-Chromium Plots Defining Alloys Having Post-Weld Ductility At, or Below, Room Temperature (75°) At Recited C + N Levels In P.P.M.

INVENTOR
Joseph J. Demo, Jr.

BY Harry J. Mc Cauley

ATTORNEY

AS CHARGED

Iso-Chromium Plots Defining Alloys Having Post-Weld Corrosion Resistance At Recited C + N Levels In P.P.M.

INVENTOR
Joseph J. Demo, Jr.

BY Harry J. McCauley
ATTORNEY

AS CHARGED

Iso-Chromium Plots Defining Alloys Having Post-Weld Corrosion Resistance At Recited C + N Levels In P.P.M.

INVENTOR
Joseph J. Demo, Jr.

BY Harry J. McCauley
ATTORNEY

AS CHARGED

Iso-Chromium Plots Defining Alloys Having Both Post-Weld Ductility At, or Below, Room Temperature (75° F.) And Corrosion Resistance At Recited C + N Levels In P.P.M.

INVENTOR
Joseph J. Demo, Jr.

BY Harry J. McCauley
ATTORNEY

AS CHARGED

Iso-Chromium Plots Defining Alloys Having Both Post-Weld Ductility At, or Below, Room Temperature (75°F) And Corrosion Resistance At Recited C + N Levels In P.P.M.

INVENTOR
Joseph J. Demo, Jr.

BY Harry J. McCauley
ATTORNEY

AS CHARGED

Iso-Chromium Plots Defining Alloys Having Post-Weld Ductility At, or Below, 0°F. At Recited C + N Levels In P.P.M.

INVENTOR
Joseph J. Demo, Jr.

BY Harry J. McCauley

ATTORNEY

AS CHARGED

Iso-Chromium Plots Defining Alloys Having Post-Weld Ductility At, or Below, 0°F. At Recited C + N Levels in P.P.M.

INVENTOR
Joseph J. Demo, Jr.

BY Harry J. McCauley
ATTORNEY

AS CHARGED

Iso-Chromium Plots Defining Alloy Having Both Post-Weld Ductility At, or Below, 0°F. And Corrosion Resistance At Recited C + N Levels In P.P.M.

INVENTOR
Joseph J. Demo, Jr.

BY Harry J. McCauley
ATTORNEY

AS CHARGED

Iso-Chromium Plots Defining Alloys Having Post-Weld Ductility At, or Below, 0°F. And Corrosion Resistance At Recited C + N Levels In P.P.M.

INVENTOR
Joseph J. Demo, Jr.

BY Harry J. McCauley

ATTORNEY

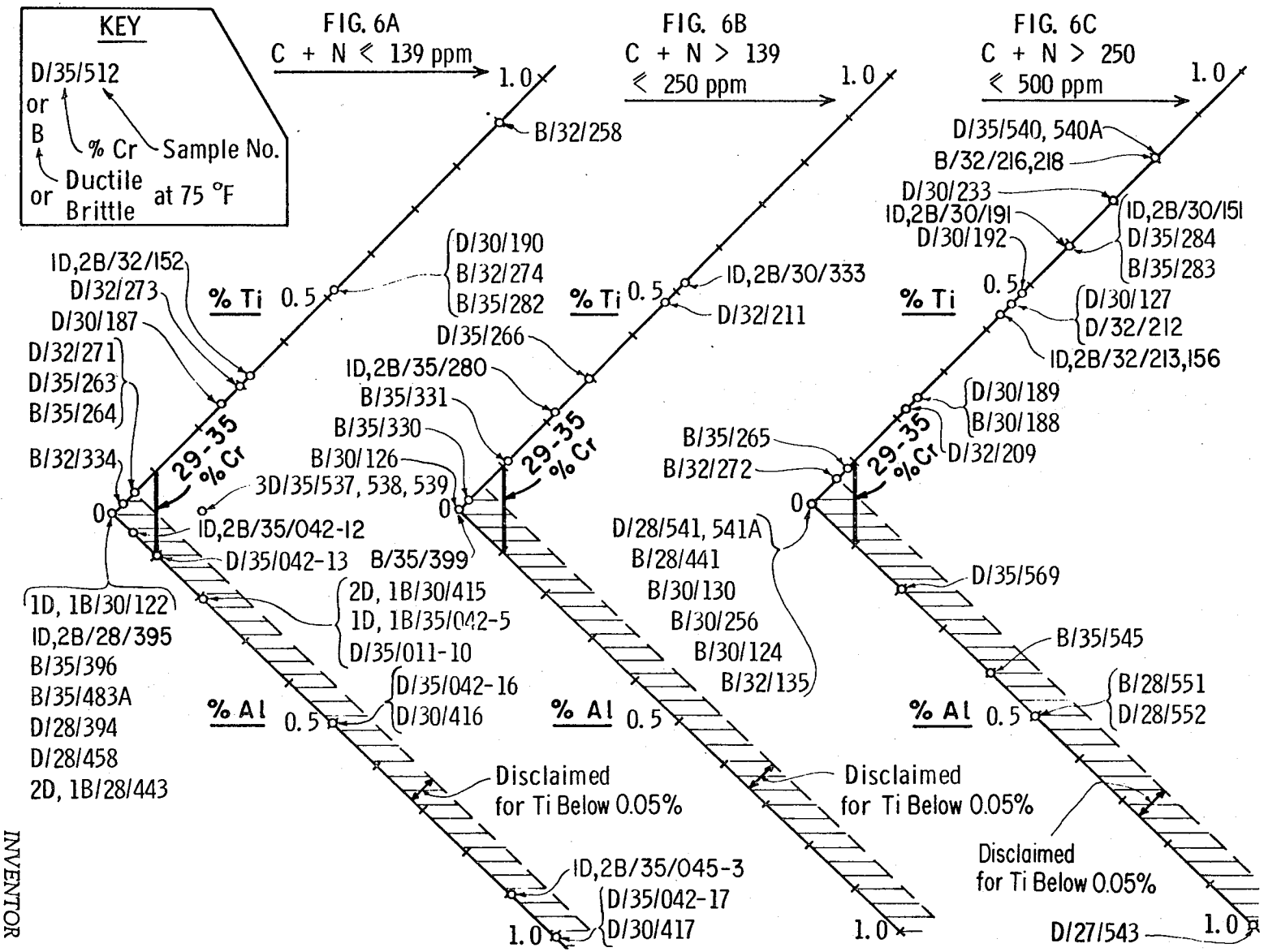
INVENTOR
Joseph J. Demo, Jr.
BY Harry J. McCauley
ATTORNEY

DUCTILE CHROMIUM-CONTAINING FERRITIC ALLOYS

CROSS REFERENCE TO RELATED APPLICATIONS

This is a continuation of application Ser. No. 371,951, filed June 21, 1973, now abandoned; which, in turn, is a continuation-in-part of U.S. application Ser. No. 153,259, filed on June 15, 1971, now abandoned; which, in turn, is a continuation-in-part of U.S. applications Ser. Nos. 51,283, filed on June 30, 1970, 886,620, filed on Dec. 19, 1969 and 847,296, filed Aug. 4, 1969, all of which are abandoned.

BRIEF SUMMARY OF THE INVENTION

Generally, this invention comprises a corrosion-resistant ferritic alloy having good post-welding ductility containing 19–35 weight percent of chromium, carbon and nitrogen collectively up to 0.28 weight percent as charged (0.15 weight percent as analyzed), and aluminum and titanium to levels giving compositions included within the areas bounded by the curves, on the concave sides thereof, the ordinate axis, titanium in weight percent of 0.05 minimum and 2.2. maximum and aluminum = 5.0 weight percent excluding, however, alloys containing 29–35 weight percent Cr having a combined Al + Ti content below 0.1% total, of at least one of the group comprising FIGS. 1, 1', 2, 2', 3, 3', 4, 4', 5 and 5' where the curves are not closed, and within the areas bounded by the curves exclusively where the curves are closed, corresponding values of aluminum and titanium for intervening chromium contents being determined, to an approximation, by linear interpolation along normals drawn from either of any one of any given pair of adjacent curves towards the other of said given pair of adjacent curves and for intervening C+N contents being determined, to a close approximation, by linear interpolation from the ordinate and abscissa axes of a given pair of adjacent plots for a preselected iso-chromium value.

DRAWINGS

As regards the inventory of drawings, and in the subsequent detailed description and claims, the simple numerical designation of drawing sets (i.e., FIGS. 1–5 and 1'–5', or subsets thereof) is intended to comprehend collectively all individual drawings of common numerical identification having added alphabetic postscripts in the interests of economy of words and clarity of expression. The following drawings (FIGS. 1–5, inclusive, representing "as charged" alloy compositions, and FIGS. 1'–5', inclusive, representing "as analyzed" alloy compositions, respective alphabetic postscripts identifying progressively increasing C+N contents) define alloy compositions in terms of weight percent aluminum as abscissa and weight percent titanium as ordinate for preselected chromium contents plotted as "iso-chromium" curves ranging from 19% chromium to 35% chromium for ten different carbon + nitrogen levels ranging from about 139 ppm through 2780 ppm in progression from Plots A through J (or through F, only, FIG. 5), wherein:

FIGS. 1 and 1' show post-weld ductility at, or below, room temperature (75° F.), FIGS. 2 and 2' show post-weld corrosion resistance, FIGS. 3 and 3' show both post-weld ductility at, or below, room temperature (75° F.) and corrosion resistance, FIGS. 4 and 4' show post-weld ductility at, or below, 0° F., FIGS. 5 and 5' show both post-weld ductility at, or below, 0° F. and corrosion resistance, and FIGS. 6A, 6B and 6C are detailed plots of ductility data at 75° F. in the regions near Ti =to 0, Al = 0 for FIGS. 1A (and 1'A'), 1B (and 1'B') and 1C (and 1'C'), respectively.

Throughout the years, many attempts have been made to use ferritic chromium alloys more extensively in industry, because the cost is considerably lower than the commonly used austenitic nickel-chromium alloys, nickel sources are becoming increasingly scarce, and nickel-free alloys have the advantage of freedom from susceptibility to stress corrosion cracking in chloride-containing environments.

Unfortunately, the high chromium ferritic alloys of the past have been severely embrittled when welded, as well as being sensitized to intergranular corrosion attack upon areas denuded of chromium by precipitation of chromium carbide, so that annealing was mandatory; however, for large or bulky vessels and the like, or complicated field-erected equipment, such as chemical plant facilities, annealing is either virtually impossible or at least highly impractical.

The problems are recognized in prior art patents such as U.S. Pat. No. 1,508,032 issued to Smith (1924) which alleges a generally corrosion-resistant high temperature alloy, without, however, providing specifics of corrosion resistance, nor information as to fabrication, prescribing a range of 15–40% Cr, with 0.04–12% Ti, 0.5–2% Mn, 0.04–3% Al, 0.5–3% Si, and unspecified C and N. However, the highest chromium content recited in examples was an 18% Cr alloy containing, also, 1.5% Mn, 1% Si, 0.2–0.35% Ti, 0.03% Al and no detailed amounts of C and N. Smith describes the role of Ti as not only a deoxidizer, but also as a scavenger of N. He states that, if C is kept as low as 0.07–0.08%, the alloy is machinable. The role of the Al is said to be like that of Si, a deoxidizer and melt fluidifier, and an oxide film former for high temperature protection. There is no teaching here enabling one to select alloys which would be, at the same time, ductile and also resistive to intergranular attack, both after welding.

To similar effect are U.S. Pat. No. 1,833,723 (1931) Ruder, teaching alloys having 15–35% Cr, 5–12% Al, and up to 1% Ti, the latter said to be a grain refiner; U.S. Pat. No. 2,597,173 (1952) Patterson, teaching Ti addition to both ferritic and austenitic stainless steels to fix C, Cr contents of 12–30% being suggested, but always together with Ni; U.S. Pat. No. 2,672,414 (1954) Phillips et al., teaching iron-chromium alloys containing Ti and residual Al for use as ductile sheet having an expansion coefficient matching glass, the preferred analysis being 15–30% Cr, C 300 ppm (or more), Ti = 0.1–2.0%, Al = 0.005–0.2%, there being no teaching whatever of post-weld ductility, corrosion resistance or N content; U.S Pat. No. 2,745,738 (1956) Phillips et al., teaching a glass-to-metal seal alloy in which the generic claim is directed to an upper limit of 20% Cr, up to 1% Al, 0.4 to 1.00% Ti and 50–1200 ppm C, the highest example, however, containing only 18.06% Cr, together with considerable Ni and Mn, and, further, preferred alloys limited to 18.50% Cr maximum; U.S. Pat. No. 3,455,681 (1969) Moskowitz, teaching a low Cr(11–14%) alloy, maintained in ferritic condition to obtain corrosion resistance and post-weld ductility, with additional advice that distribution of other ingredients should be such that martensite cannot form, 0.2–1.0% Ti being used to fix the C, which is limited to 1000 ppm, whereas N is limited to 500 ppm and up to 1.5% of Al is added to promote oxidation resistance; and German Patent 1,938,616, Chalk, assignor to Armco Co. (filed in U.S. as Ser. No. 748,971, 7/31/68) disclosing the use of Al in a 16–19% Cr alloy to give high temperature oxidation resistance and Ti to fix C and N in order to give post-weld ductility, the highest Cr content example being 17.76% Cr, together with 2.15% Al, 0.49% Ti, 0.046% (460 ppm) C, 0.037% (370 ppm) N, 0.53% Mn, 1.02% Si, balance iron, there being a stated preference for C contents below 700 ppm and N below 300 ppm, without any teaching of Ti or Al functionality with respect to C and N contents, the sole expressed interest being deoxidation, melt viscosity and oxide scaling prevention.

Recently, associates of applicant, and applicant himself, have discovered that, up to somewhat above 35% Cr content, the brittleness after welding can be prevented if the C and N contents of the alloys can each be (a) sufficiently lowered (as claimed in applicant's application Ser. No. 1781 filed Jan. 9, 1970), (b) "neutralized" in their effects by the addition of certain solid-solution forming metals (as claimed by Sipos, Steigerwald and Whitcomb in their joint applications Ser. No. 707,350 and 34,166), or (c) "fixed" by the addition of Ti, presumably to form titanium carbide and nitride (as claimed in applicant's parent Application Ser. No. 847,296, supra, and also in his refile Application Ser. No. 886,620, supra, filed December 19, 1969).

Applicant has now carried his researchd further and has found that, surprisingly, when titanium and aluminum are employed together, the deleterious effects of relatively high contents of carbon and nitrogen on post-weld ductility are avoided for even high chromium content ferritic alloys where enhanced corrosion resistance over a relatively wide range of alloy compositions is concurrently obtained. The concerted operation of Ti and Al as additives is not understood and the situation is complicated by the fact that at least five interacting variables, i.e., Cr, Ti, Al, C and N are involved over quite broad ranges. Moreover, the several regions in which the benefits are obtained, e.g., post-weld ductility at room temperature (75° F.), plotted in FIGS. 1 and 1', post-weld corrosion resistance, plotted in FIGS. 2 an 2', and post-weld ductility at, or below, 0° F., plotted in FIGS. 4 and 4', do not coincide perfectly, as shown by FIGS. 3 and 3', and 5 and 5', respectively.

By "post-weld ductility", as the term is employed in this Application, is meant ductility in a 180° transverse weld bend test of an air-cooled welded specimen in the as-received (i.e., unannealed) condition according to the standard guided bend test provided in the ASME Pressure Vessel Code, 1965, Section IX, page 59, using a plunger having a preselected radius giving a preselected ratio of bend radius to sample thickness, all as hereinafter described in Sections I and II, subsections 4a.

In view of the complexity of the problem, the field of research was scouted at the outset by statistical analysis techniques and particularly critical compositions forecast to permit the identification of sixty-four alloys which would constitute the most accurate and meaningful explorations. Thereafter, these alloys were all prepared to careful specifications hereinafter described and all were tested, thereby providing data on each of two bases, i.e., as charged and as analyzed, enabling the fitting of two sets of mathematical equations thereto, these permitting respectively, the computation of (1) brittle-ductile transition temperatures and (2) resistance to intergranular corrosion for alloys comprising 19–35 wt. % Cr, 0.05–2.2 wt. % Ti, 0–5 wt. % Al, combined totals of 0–0.28 wt. % C and N for the as charged (and 0–0.15 wt. % C+N for the as analyzed), the balance being iron together with small amounts of impurities normally found in alloys of the class involved, these being chiefly 0–0.010% S, 0–0.010% P, 0–0.8% Mn and 0–0.5% Si.

Subsequent to the filing of application Ser. No. 51,283, supra, it became apparent that the predicted alloy compositions near the origins of the curves (Ti = 0, Al = 0) for carbon plus nitrogen contents up to about 500 ppm were in poor agreement with known quantities of a few actual alloys containing little or no Ti and or Al. Accordingly, an additional set of experiments was carried out to supplement those heretofore completed. By statistical analysis seventeen additional compositions (including repeats, refer TABLE II-B) in the vicinity of the origins were selected, and these prepared and tested, and their results inserted into the combined data base, together with the original compositions. From this enlarged data base, a new set of correlation equations and their regression coefficients was established, and the new sets of FIGS. 1–5 (and 1'–5') now in this refile were drafted from these equations.

Further to firm up the effect of very small quantities of titanium and aluminum, older data were brought into the case from three sources: (1) application Ser. No. 886,620 filed Dec. 19, 1969, previously referenced on page 1 hereof, concerned additions of titanium alone to ferritic alloys; (2) application Ser. No. 34,166, dated May 4, 1970, by Sipos, Steigerwald and Whitcomb, and of common assignment with the present invention, which concerns among other additives the addition of solely aluminum to ferritic alloys containing 28–35% chromium and up to 700 parts per million of carbon plus nitrogen; (3) application Ser. No. 1781 dated Jan. 19, 1970, concerning ferritic alloys of chromium improved by reduction of carbon and nitrogen to extra low levels, and containing neither titanium nor aluminum.

These data, taken together with the data of application Ser. No. 153,259, form the basis for FIG. 6, depicting in magnified detail the region near Ti = 0, Al = 0 and chromium contents from about 29% to 35%, and establishing the basis for the short lines labelled "29–35" in the lower left corners of Figures such as 1A.

These older data having been taken in somewhat different manner were not amenable to direct inclusion in the aforesaid statistical correlation.

In additional experiments, molybdenum was added to some of the foregoing alloy compositions as charged, and it was found that substantial corrosion resistance enhancement resulted.

The equations are both of the involved quadratic form:

$$y = b_0 + b_1x_1 + b_2x_2 + b_3x_3 + b_4x_4 + b_{12}x_1x_2 + b_{13}x_1x_3 + b_{14}x_1x_4 + b_{23}x_2x_3 + b_{24}x_2x_4 + b_{34}x_3x_4 = b_{11}(x_1)^2 + b_{22}(x_2)^2 + b_{33}(x_3)^2 + b_{44}(x_4)^2$$

in which $x_1$ = wt. % Cr $x_2$ = wt. % Ti $x_3$ = wt. % Al $x_4$ = ppm C+N, and the regression coefficients $b_1$, $b_2$, etc., are set forth in Tables I and I′, infra, whereas $y$ = brittle-ductile transition temperature, °F., on welded samples when the coefficients of TABLE I (as charged) and TABLE I′ (as analyzed) in the column headed "BDTT", i.e., Brittle-to-Ductile transition Temperatures are used in the equations, and $y$ = corrosion rating for intergranular attack (according to a system hereinafter detailed in which a rating above 2.0 is unsatisfactory performance) when the coefficients in the column headed "Corrosion" of TABLE I (as charged) and TABLE I′ (as analyzed) are used in the equations.

In summary, the equations are useful for identifying ferritic stainless steels according to this invention consisting essentially of, besides iron and incidental impurities, 19–35 weight percent Cr, C+N collectively up to 0.28 weight percent as charged (or 0.15 weight percent as analyzed), Ti 0.05 weight percent minimum to 2.2 weight percent maximum, aluminum up to 5.0 weight percent (excluding, however, alloys containing 29–35 weight percent Cr having a combined Al + Ti content below 0.1% total) having compositions such that preselected values of Cr, C+N, Al and Ti, when inserted in the quadratic equations supra utilizing the applicable Regression Coefficients set forth in TABLE I for As Charged Compositions and TABLE I′ for As Analyzed Compositions, give acceptable (1) Brittle-Ductile Transition Temperatures of 75° F. maximum and (2) corrosion ratings for intergranular attack of 2.0 maximum.

TABLE I

AS CHARGED REGRESSION COEFFICIENTS

| | Brittle-Ductile Transition Temperature (° F.) | Corrosion |
|---|---|---|
| $b_0$ | −421.19042587 | 3.99979264 |
| $b_1$ | 25.90555525 | −.02185620 |
| $b_2$ | −77.57899094 | −2.50678477 |
| $b_3$ | −25.13413191 | −.16329981 |
| $b_4$ | .06318742 | .00092183 |
| $b_{11}$ | −.39748063 | −.00087280 |
| $b_{12}$ | −.57044795 | −.00039548 |
| $b_{13}$ | 1.43657050 | −.00425525 |
| $b_{14}$ | .00164771 | .00000638 |
| $b_{22}$ | 94.95380306 | .92988101 |
| $b_{23}$ | 18.85228729 | .00578567 |
| $b_{24}$ | −.11013990 | −.00019057 |
| $b_{33}$ | 1.26838751 | .05628382 |
| $b_{34}$ | −.00111274 | −.00002480 |
| $b_{44}$ | .00001538 | −.00000013 |

TABLE I′

AS ANALYZED REGRESSION COEFFICIENTS

| | Brittle-Ductile Transition Temperature (° F.) | Corrosion |
|---|---|---|
| $b_0$ | −275.2 | 4.723 |
| $b_1$ | 14.24 | −.1315 |
| $b_2$ | −95.01 | −2.649 |
| $b_3$ | −14.92 | −.2455 |
| $b_4$ | .1657 | .003262 |
| $b_{11}$ | −.1894 | .001331 |
| $b_{12}$ | 3.135 | .002874 |
| $b_{13}$ | .8029 | −.003389 |
| $b_{14}$ | −.0009177 | −.000005357 |

TABLE I′-continued

AS ANALYZED REGRESSION COEFFICIENTS

| | Brittle-Ductile Transition Temperature (° F.) | Corrosion |
|---|---|---|
| $b_{22}$ | 86.76 | 1.024 |
| $b_{23}$ | 16.12 | .05924 |
| $b_{24}$ | −.2376 | .0005578 |
| $b_{33}$ | 2.542 | .07085 |
| $b_{34}$ | .007492 | −.0001018 |
| $b_{44}$ | .00007919 | −.0000007922 |

The solutions of the foregoing equations are, of course, practicably made only with the aid of a computer. The series of curves plotted in FIGS. 1–5 and FIGS. 1′–5′, inclusive, constitute solutions of the equations for the several values of the five variables reported, the validity of the plots being confirmed, within the limits of reproducibility of the data itself, by the eighty-one alloys hereinafter reported.

On further comparison of correlation vs. actual data it was found that the sensitivity of the correlation process is slightly inadequate for ductility at 75° F. at the location near Ti = 0%, Al = 0%, Cr = 29–35%, and C+N = 139–500 ppm. This location is the bottom left corner of pertinent Figures (e.g., 1A), and here a straight line connecting Ti = 0.1%, Al = 0.0% with Ti = 0.0%, Al = 0.1% has been drawn in manually. This line brings out the experimental fact that even at the low C+N content of less than 500 ppm, if the Cr content is high, a modicum of Ti and/or Al is necessary in order to obtain metal that is ductile at 75° F. as-welded.

In addition to the data from the eighty-one samples previously mentioned, other data (in form not suited to incorporation in the data base for the aforesaid equations) have been accumulated and will be interpreted subsequently.

SUMMARY STATEMENT OF THE INVENTION

1. Broadly stated, this invention comprises those ferritic alloys of iron, chromium, carbon, nitrogen, titanium and aluminum which are ductile in their as-welded condition at a temperature of 75° F., these alloys containing 19–35 wt. percent chromium, up to 0.28 wt. percent of the sum of carbon plus nitrogen as charged (up to 0.15 wt. percent of the sum of carbon plus nitrogen as analyzed), 0.05–2.20 wt. percent titanium, 0–5.0 wt. percent aluminum, the balance being iron and the normal impurities usually associated with alloys of the type involved, these alloys being further limited by the fact that their compositions fall on the concave sides of the several isochromium plot lines of FIGS. 1 and 1′.

2. A preferred species of this invention comprises those alloys of summary 1, supra, which are also ductile at lower temperatures, i.e., 0° F., as determined by the fact that their compositions lie on the concave sides of the several iso-chromium plot lines of FIGS. 4 and 4′.

3. Yet other preferred species of this invention comprises those alloys of summary 1, supra, which are, at the same time, resistant to corrosion as denoted by the fact that their compositions fall on the concave sides of the several iso-chromium plot lines, or within the closed curves thereof, if these are complete, for post-weld ductilities at 75° F., FIGS. 3 and 3′, and 0° F., FIGS. 5 and 5′, respectively.

4. Yet other preferred species of this invention comprise those alloys of summary 1, supra, to which up to about 1.5 weight percent of molybdenum is added for special enhancement of corrosion resistance while still retaining post-weld ductility.

5. An even more preferred species of this invention comprises those alloys of Summary 1, supra, comprising

| | | |
|---|---|---|
| 25 | - | 29 % Cr |
| 0.9 | - | 1.5% Ti |
| 0 | - | 1.5% Al |
| 0 | - | 1.5% Mo |

up to 750 ppm C+N, as charged the balance being iron and the usual impurities, and further limited in that the sum of the titanium and aluminum content shall not exceed 2.5%.

6. A preferred species of lower carbon and nitrogen content comprises

| | | |
|---|---|---|
| 25 | - | 29 % Cr |
| 0.75 | - | 1.4% Ti |
| 0 | - | 1.5% Al |
| 0 | - | 1.5% Mo |

and the balance being iron and the usual impurities, and further limited in that the sum of the titanium and aluminum content shall not exceed 2.4%.

INVESTIGATIVE PROCEDURE

Eighty-one alloys were prepared, melted, rolled into samples, heat treated, welded and then tested for bend ductility and for intergranular corrosion resistance in accordance with the following practice. In addition, from earlier work as mentioned supra, sixty-one alloys were selected, these including all of the alloys from application Ser. No. 886,620 having less than about 1.0% titanium as the sole additive and containing at least 28% chromium, and all of the alloys in application Ser. No. 34,166 that contained as the sole additive aluminum to the extent of 1.0% or less together with some alloys from application Ser. No. 1781. The preparation and treatment of these sixty-one alloys was slightly different from that of the eighty-one alloys first mentioned, and the differences will be explained later.

I. Alloy Preparation and Testing for the eighty-one Alloys

1. Charge

The alloys were made as 1000 gm. charges from high purity chromium, iron, aluminum and titanium. The appropriate C+N additions were made by using, respectively, a high carbon ferrochrome (9% C) and a high nitrogen ferrochrome (6% N). Based on previous experience, the charges were weighed out assuming 100% utilization of Cr and Fe, 80% of the Al, 90% of the Ti, and 90% and 60%, respectively, of the carbon and nitrogen.

2. Melting and Processing

The charge was placed in a 500 cc recrystallized alumina crucible. The melting was done in a Vacuum Industry, Inc., induction melting furnace. After placing the charged crucible in the induction coils, the chamber was evacuated and power applied slowly. When the melting was complete, the vacuum chamber was back-filled with gettered argon to 13 psi absolute. The sample was held in the molten state for 30 minutes to insure adequate homogenization, after which the melt was poured into a copper crucible mold.

The hot top was cut from the ingot, to remove any piping, and the sound ingot, coated with "Metlseal A-249", a protective coating marketed by Foseco, Inc., Cleveland, Ohio, was soaked for 3 hours at 2200° F. Then the hot ingot was hammer-forged at temperature to one inch thickness to give a slab measuring about 2½ × 2½ inches. This slab, at 2200° F., was then hot rolled in one direction in air to 5 inches length, then cross rolled in the other direction to give a "hot band" piece with dimensions approximately 5 × 5 × 0.22 inches. The hot band was annealed 60 minutes at 1650° F., followed by a water quench.

A small piece of this annealed hot band was cold rolled. If no cracking was observed, or twinning heard, the remaining large piece of annealed hot band was cold rolled to sheets about 5 inches wide × 12 inches long × 0.1 inch thick. When the small test piece of the annealed hot band cracked during cold rolling, the large pieces were reheated to 2200° F. and hot rolled to a thickness of 0.095–0.10 inch. Following the cold or hot rolling process, the sheets were annealed for 30 minutes at 1560° F. and water quenched. The quenched sheets were sand blasted preparatory to welding.

3. Welding

The samples were clamped in a hold-down jig which provided inert gas circulation to the bottom side of the weld. The welding torch was held in a clamp attached to a power-driven carriage which controlled the welding speed. For each weld pass, the current, voltage and welding speeds were all recorded.

The samples were tungsten-inert gas welded using a 3/32 inch pointed thoriated tungsten tip, a ⅝ inch gas cup and argon purge gas to protect the top side of the weld. For most samples, the cold rolled and annealed 0.1 inch sheet stock was clamped in the hold-down jig and a 9 to 12 inch long weld bead laid down. The sample was then moved until three or four equally spaced parallel longitudinal weld beads were laid down. After welding, the weld beads were labeled appropriately and the sample cut into separate strips measuring approximately 1 × 3 × 0.1 inches, each carrying a centrally disposed longitudinal weld bead. For a few compositions, which were found to be brittle, it was necessary to cut the cold rolled annealed 0.1 inch sheet into strips 1 × 12 inch length × 0.1 inch thick. Each strip was then given a longitudinal weld as described, supra.

Since travel speed, voltage and current were recorded, heat inputs for all welded samples are known. In general, good weld penetration was obtained with heat inputs within the range of 7,500 to 11,500 Joules/in.

4. Testing (a) BDTT (Brittle-Ductile Transition Temperatures)

A modified ASME guided bend test jig was used to measure the BDTT temperature of the welded samples. The design was modified to insure that the plunger was always centered with respect to the base. The bend jig was attached to the cross head of an Instron tensile testing machine to produce and maintain a constant bending speed. The jig was also enclosed in an environmental chamber to permit temperature control in the range of −75° F. to 600° F. The bend test jig, conforming to the ASME Boiler Code qualification test for welded samples, had a 200 mil radius for the 100 mil samples, thereby giving a bend radius to sample thickness ratio of 2.

The samples were bent 180° over the plunger at a cross head speed of 2 inches/min. Samples were tested at room temperature first. Then, depending upon whether cracking or no cracking was observed, the temperature was raised or lowered. The high temperature experiments were run at 50° F. increments above 75° F. (i.e., room temperature) to 225° F., then at 100° F. increments to 525° F., the practical limit of the heating unit. The lower temperature experiments were run at 50° F. increments below 75° F. to, and including, −75° F., the lower limit of the chamber. In the chamber, high temperatures were obtained by resistance heating, while temperatures below room temperature were obtained through adiabatic expansion of $CO_2$ gas.

Before embarking on the BDTT testing program, the results of which are reported in Tables IIA and IIB, infra, preliminary experiments were conducted on two 1000 g. buttons processed and welded as described, supra. It was desired to ascertain, for certain, that a relatively sharp break in the BDTT curve did occur with temperature. Accordingly, two available alloy samples were taken, containing 0.4% Al, zero percent Ti each, one of which, No. 437E, contained 35% chromium and 342 ppm C+N whereas the other of which, No. 438E, contained 40% chromium and 421 ppm C+N. Welded pieces of 437E were already known to be ductile at room temperature, whereas 438E was brittle. Then welded specimens of each were given the BDTT test, as described, supra, proceeding in sequence from room temperature downwardly for 437E and upwardly for 438E.

It was determined that, within a 50° F. change in temperature, there existed a sharp change from brittle to ductile behavior. For sample 437E, ductile at room temperature, the BDTT occurred between +20° F. and −25°0 F. For sample 438E, the BDTT occurred between 130° and 180° F. Thus, it could be seen, in advance, that relatively sharp BDTT values existed, a fact which was subsequently confirmed for all of the titanium and aluminum containing specimens which were later tested and reported in Tables IIA and IIB.

(b) Analyses

For the purposes of the statistical analysis, it was necessary to determine that the alloy compositions were sufficiently close to the compositions required.

Accordingly, all samples were analyzed for C, N, Cr, Al and Ti, the Cr, Al and Ti being determined using X-ray fluorescence technique. Carbon was analyzed by a combustion technique in which the evolved $CO_2$ was measured on a gas chromatograph. Nitrogen was analyzed by the micro-Kjeldahl and gas fusion methods, in the former of which nitrogen compounds are reduced to $NH_3$, which is then titrated, whereas, in the latter, the sample is fused to expel nitrogen, which is then measured by gas chromatography. It will be noted that both of these techniques require that the nitrides be broken down. For the highly stabilized alloys of this invention, the analytical results for nitrogen were very erratic, possibly due to lack of complete breakdown of the nitrides.

(c) Intergranular Corrosion Test

The majority of applications of as-welded ferritic steels of the present invention are expected to require not only the ductility referred to in section (2) supra, but also a high resistance to intergranular corrosion of the type caused by formation of chromium carbide in the grain boundaries. Such carbide formation seems to cause a partial removal of chromium from solution in the region surrounding each microscopic carbide crystal, and such regions, denuded of their chromium, are then susceptible to corrosion in various media. ASTM Corrosion Test A262-70 (Practice B) covers a test method based upon boiling 50% $H_2SO_4$ containing ferric sulfate, which is accepted by many corrosion experts as a good accelerated test for disclosing alloys susceptible to the kind of intergranular attack hereinabove described. However, as noted in the ASTM bulletin A262-70, this test (Practice B) may reveal in certain alloys those that may also be susceptible to intergranular attack from a different cause, namely metallurgical phases "sigma", "chi", and others. The presence of these latter phases does no lead to intergranular attack in most environments.

For those alloys of the present invention that show marginal lack of resistance to intergranular attack by the aforesaid ASTM Test, Practice B, there are specified in the same Standard two tests designated Practices D and E; in Practice D, nitric acid and hydrofluoric acid are used; in Practice E, copper - copper sulfate - sulfuric acid are used. By these tests those samples that are marginally lacking in resistance by Practice B test (rating 2 – 2.5, versus rating 2.0 as explained hereinafter) because of secondary phase other than chromium carbide do not display intergranular attack, and may be rated as 2.0 or better.

Since the formation of phases such as "chi"-phase seems to be more likely in those samples containing molybdenum and small amounts of phosphorus, sulfur, or silicon (the latter of which can be left over from foundry deoxidation practice) only the samples of such compositions need to be subjected to this additional testing. The Table V below lists samples so tested, and the results of the tests, and shows the improved screening from the Practice D and E tests, in the results for Sample No. 5582.

TABLE V

TEST RESULTS
PRACTICES D AND E

| | CONTENT —Bal. Fe | | | | | | | | AS-WELDED RATING | | |
|---|---|---|---|---|---|---|---|---|---|---|---|
| | | | | | | | | | Practice B | Practice D | Practice E |
| ALLOY NO. | Cr wt.% | Ti wt.% | Al wt% | Mo wt.% | Si wt.% | P wt.% | S wt.% | C+N ppm | $Fe_2(SO_4)_3$ $H_2SO_4$ | HF $HNO_3$ | $CuSO_4$ $H_2SO_4$ |
| 587 | 25.9 | 0.0 | 0.0 | 0.94 | 0.005 | 0.004 | 0.003 | 620 | 4.0 | 4.0 | 4.0 |
| 588 | 25.9 | 1.03 | 0.49 | 0.88 | 0.005 | 0.004 | 0.003 | 680 | 1.5 | 1.0 | 1.0 |
| 5582* | 26.2 | 0.75 | 0.46 | 1.02 | 0.13 | 0.014 | 0.013 | 570 | 2.5 | 1.0 | 1.0 |

TABLE V-continued

TEST RESULTS
PRACTICES D AND E

| ALLOY NO. | CONTENT —Bal. Fe Cr wt.% | Ti wt.% | Al wt% | Mo wt.% | Si wt.% | P wt.% | S wt.% | C+N ppm | AS-WELDED RATING Practice B $Fe_2(SO_4)_3$ $H_2SO_4$ | Practice D HF $HNO_3$ | Practice E $CuSO_4$ $H_2SO_4$ |
|---|---|---|---|---|---|---|---|---|---|---|---|
| 599 | 26.0 | 1.00 | 0.45 | — | 0.20 | 0.004 | 0.003 | 573 | 1.5 | 1.0 | 1.0 |

*50-lb heat made under actual foundry conditions

Corrosion test coupons were cut from the unstressed ends of the welded samples, given an 80-grit wet belt finish and then subjected to the corrosion test, ASTM A 262-64T, 1965 Book of Standards, pp. 217–239, which consists of immersion in boiling 50% $H_2SO_4$ containing 41.6 gms/liter of ferric sulfate as inhibitor in repeated cycles of 24 hours duration, up to a total exposure of 120 hours. Individual samples were rinsed, dried and weighed after each 24 hour acid immersion, and the corrosion rate determined.

In addition, the samples, particularly the weld areas, were examined visually and at 40X magnification for signs of corrosion, as demonstrated by grain dislodgement or crevicing preceding dislodgement, and specimens were rated as described infra.

(d) Interpretation of Corrosion Results

The corrosion samples were arbitrarily evaluated according to the following scale, after examination both by the unaided eye and a 40X microscope.

| Scale | Rating | Observation |
|---|---|---|
| 1.0 | Pass | No attack |
| 1.5 | Pass | Light etching, confined to the weld metal. |
| 2.0 | Pass | Slight crevicing, but only on the weld metal. |
| 3.0 | Fail | Moderate attack, with numerous grains dropping from weld. |
| 4.0 | Fail | Severe attack, with general grain dropping, or dissolution of the weld. |

As noted in the "Rating" column, Tables IIA and IIB, any sample that displayed more than slight attack in the weld was evaluated as a failure and given a numerical scale rating above 2.0.

(e) Experimental Results

The data collected are gathered into Tables IIA and IIB, which also include two columns headed "Predicted", one of these being under the general heading "BDTT(° F.)", i.e., Brittle-to-Ductile Transition Temperature (° F.), and the other being under the heading "Corrosion Rating", which latter is according to the appraisal scale 1–4 described supra. Table IIB contains data added by application Ser. No. 153,259.

The values in both of these Predicted columns are the result of fitting, by standard statistical methods, equations of the general form hereinbefore set out and then solving these equations for the values shown. It will be seen that there exist discrepancies between the predicted values and the measured values. However, more than 80% of the total information available on a mean square basis is reproduced by the model.

Following is a discussion of the statistical significance of the curves. In FIGS. 1A – 1J (and 1'A'– 1'H'), inclusive, are shown curves depicting within the concave sides, the regions of alloys having BDTT of 75° F. and lower, and in FIGS. 4A–4J (and 4'A'–4'H'), for 0° F. and lower. For Example, in FIG. 1A a sample containing (as charged) as much as 139 ppm C+N, 0.5% Ti, and 2.0% Al is indicated to be ductile at and above 75° F. if it contained any amount of chromium in the range of 19 – 35% since it is on the concave side of all these isochromium curves. However, if it contained 3% Al (as charged) instead of 2%, it is indicated to be ductile only if it contained less than about 30% chromium.

On the "as analyzed" basis, FIG. 1'A' is in agreement with FIG. 1A; however, 29% Cr is the upper limit for 3% Al per FIG. 1'A'.

These ductility (BDTT) curves are the computer output representing the quadratic equation best correlating the experimental data. Gauged by statistical measures of quality, this equation reveals significant effects of the compositional variables to better than 99% level of significance.

As is well known in metallurgical fields, data for BDTT are highly subject to scatter, and it is common to find differences of 60° F. and greater in the BDTT of supposedly identical samples. As is illustrated in Reed-Hill ("Physical Metallurgy Principles" published by D. Van Nostrand Co., Princeton, N. J., 1964, p. 553) for low temperature impact strength, such data are plotted as bands to indicate the scatter of experimental measurements. In the illustration cited, most of the bands are wider than 50° F. According to Dieter ("Mechanical Metallurgy" McGraw-Hill Book Co., New York, 1961, pp. 373–374) most of the scatter is due to local variations in the properties of the steel.

The standard replication error of applicant's data is 64° F.; this value compares satisfactorily with the general data accuracy limits discussed supra. Extension of the statistical analysis shows that the quadratic equation correlating these data fits the data with essentially the same level of precision as that of the experimental data.

When one considers that past corrosion-resisting ferritic alloys had as-welded BDTT's of 200° F. and higher, the present result is highly significant, not only from the statistical point of view, but also from the metallurgical point of view, for selecting alloys not available from the prior art.

In making such selections, good common sense will dictate that one should preferably stay well into the central areas of ductile material, away from the margins defined by the curves. If circumstances necessitate selecting compositions close to the margins, samples of the compositions desired should preferably be made and tested before large-scale preparation is initiated.

An alternative way of increasing the safety of selection is by utilizing as the selecting criterion a lower BDTT than needed; a simple way of doing this is by selecting for 75° F. the BDTT composition utilizing FIGS. 4 (or 4') and 5 (or 5') (or the quadratic equation supra), which depict those compositions predicted to have BDTT equal to 0° F., thus obtaining a 75° F. improvement in safety margin. Statistical analysis indicates that use of this criterion of safety by selection within the 0° F. curves for 75° F. use will increase the probability of securing alloys ductile at 75° F. to about 85%.

The above paragraphs have dealt with the significance of the correlation for bend ductility transition temperature. Similar considerations apply to the correlation for intergranular corrosion resistance, as follows:

It was explained, supra, that the degree of attack was made quantitative by assigning an arbitrary rating in the range from 1 through 4, with all ratings up to and including 2.0 being considered "passing". In the units of this rating system, the equation fitted to the corrosion data, when tested by statistical rules, was found to represent more than 65% of the total information expressed on a mean square basis, and to have a residual standard deviation of approximately the same order as the standard deviation of the corrosion test replicates.

As with the ductility data, rather than operating close to the margin of any of the compositional areas shown by the curves as being passable, it is wiser to select compositions toward the middle of the areas; if this is not possible, then samples should be made and tested before engaging in large-scale operations.

Another approach is like that explained supra, namely, the solution of the equations using as input some suitably lower value of the corrosion limitation. Figures for this approach have been omitted in the interests of brevity.

Another part of the problem that exists (in addition to the variability in ductility and corrosion rating results), as reflected by the data of Table IIA and IIB, is the lack of good agreement in nitrogen content between the charged sample compositions and the compositions determined by quantitative analysis of the resulting alloys. The reason for the non-agreement is believed to be the extreme stability of the several compounds of Ti, Al, C and N which exist in the alloys, so that these do not necessarily break down fully under the standard analytical procedures utilized. It may be that improved analytical techniques evolved in the future will provide closer agreement; however, for the present, the better course appears to be to rely on the "as charged" basis in designation of the data plots of FIGS. 1 to 5, inclusive, and this is what applicant has done. Nevertheless, complete graphical representation of the data upon which this invention is based necessitates inclusion of the "as analyzed" relationships, too, and this is now supplied by FIGS. 1' – 5', inclusive.

The correlating curves define broad areas within which compositions will be expected to have the designated properties:

| | | |
|---|---|---|
| FIGS. 1A – 1J, and 1'A'– 1'H' | - | Ductility at 75° F. as welded |
| FIGS. 2A – 2J, and 2'A'– 2'H', | - | Corrosion Resistance as welded |
| FIGS. 3A – 3J, and 3'A'– 3'H' | - | Both ductility at 75° F. and corrosion resistance |
| FIGS. 4A – 4J, and 4'A'– 4'H' | - | Ductility at 0° F. as welded |
| FIGS. 5A – 5F, and 5'A'– 5'C' | - | Both ductility at 0° F. and corrosion resistance |

Within the areas of these curves there are certain regions which are especially favored, and in these regions applicant has selected the following preferred species:

| | | | |
|---|---|---|---|
| Species I | | | |
| Cr | 25 | – | 29 % |
| Ti | 0.9 | – | 1.5% |
| Al | 0 | – | 1.5% |
| Mo | 0 | – | 1.5% |
| C+N | up to 750 ppm (as charged) | | |
| Ti + Al | ≦ 2.5% | | |
| Fe + incidental impurities | balance | | |
| Species II | | | |
| Cr | 25 | – | 29 % |
| Ti | 0.75 | – | 1.4% |
| Al | 0 | – | 1.5% |
| Mo | 0 | – | 1.5% |
| C+N | up to 500 ppm (as charged) | | |
| Ti + Al | ≦ 2.4% | | |
| Fe + incidental impurities | balance | | |

These species fall in the ranges of greatest commercial importance, bracket certain of the actual experimental samples, possess both ductility at 75° F. and intergranular-attack corrosion resistance in the as-welded condition, and fall within the curves of FIG. 3 pertaining to 29% Cr and higher for 500 ppm C+N for Species II and 750 ppm C+N for Species I. (The 29% Cr curves define smaller areas of ductile corrosion-resisting material than do the 25% Cr curves.)

Both species I and II tolerate a permissible molybdenum content of up to 1.5%. The experimental verification of the molybdenum content is detailed, infra, in connection with Table IV.

The following Tables IIA and IIB present applicant's confirmatory data supporting the several plots of the FIGURES and is the experimental basis for the conclusions presented infra, except for the short lines in FIGS. 1A, 1'A', 1B, 1'B', 1C and 1'C', marked "29-35". The positions of these lines are based in part on the data in Tables IIA and IIB, and in part on the data presented later in Table III and discussed in Section II (5), and plotted on expanded scale in FIG. 6.

TABLE II-A

COMPILATION OF ALLOY COMPOSITIONS AND EXPERIMENTAL AND PREDICTED VALUES FOR POST WELD DUCTILITY AND CORROSION RESISTANCE — PART I

| | Charged | | | | | | Analyzed | | | | | | | | | |
|---|---|---|---|---|---|---|---|---|---|---|---|---|---|---|---|---|
| | wt% | | | ppm | | | wt% | | | ppm | | | BDTT°F[1] | | Corrosion Rating | |
| Alloy No. | Cr | Ti | Al | C | N | C+N | Cr | Ti | Al | C | N | C+N | Measured | Predicted | Measured | Predicted |
| A. 19%Cr Alloys | | | | | | | | | | | | | | | | |
| 488 | 19 | 0 | 0 | 56 | 83 | 139 | 19.7 | — | — | 21 | 60 | 81 | −50 | −59 | 2.5 | 3.4 |
| 481 | 19 | 2.2 | 2.5 | 56 | 83 | 139 | 17.5 | 2.2 | 2.2 | 23 | 120 | 143 | 150 | 297 | 2.0 | 2.1 |

TABLE II-A-continued

COMPILATION OF ALLOY COMPOSITIONS AND EXPERIMENTAL AND PREDICTED VALUES FOR POST WELD DUCTILITY AND CORROSION RESISTANCE — PART I

| | Charged | | | | | | Analyzed | | | | | | | | | |
|---|---|---|---|---|---|---|---|---|---|---|---|---|---|---|---|---|
| | wt% | | | ppm | | | wt% | | | ppm | | | BDTT°F[1] | | Corrosion Rating | |
| Alloy No. | Cr | Ti | Al | C | N | C+N | Cr | Ti | Al | C | N | C+N | Measured | Predicted | Measured | Predicted |
| 511 | 19 | 1.1 | 0 | 556 | 824 | 1380 | 18.6 | 0.9 | — | 270 | 238 | 503 | 0 | −62 | 2.0 | 2.5 |
| 518 | 19 | 2.2 | 0 | 556 | 824 | 1380 | 18.1 | 1.9 | — | 520 | 117 | 637 | 0 | 21 | 2.5 | 2.9 |
| 523 | 19 | 1.1 | 2.5 | 556 | 824 | 1380 | 17.1 | 0.8 | 2.4 | 537 | 95 | 632 | 100 | −0.8 | 2.5 | 2.2 |
| 499 | 19 | 2.2 | 2.5 | 556 | 824 | 1380 | 17.5 | 1.8 | 2.3 | 578 | 100 | 678 | 50 | 136 | 3.0 | 2.6 |
| 485 | 19 | 0 | 5.0 | 556 | 824 | 1380 | 17.7 | — | 4.6 | 682 | 93 | 775 | 50 | 122 | 4.0 | 4.5 |
| 485A | 19 | 0 | 5.0 | 556 | 824 | 1380 | 17.0 | — | 4.4 | 554 | 97 | 653 | 100 | 122 | — | — |
| 515 | 19 | 0 | 0 | 1110 | 1670 | 2780 | 19.9 | — | — | 846 | 90 | 936 | 100 | 309 | 4.0 | 5.2 |
| 490 | 19 | 1.1 | 0 | 1110 | 1670 | 2780 | 19.3 | 0.6 | — | 1169 | 367 | 1536 | 50 | −12 | 4.0 | 3.1 |
| 520 | 19 | 2.2 | 0 | 1110 | 1670 | 2780 | 18.6 | 1.5 | — | 913 | 323 | 1236 | −50 | −98 | 3.0 | 3.0 |
| 501 | 19 | 1.1 | 2.5 | 1110 | 1670 | 2780 | 18.4 | 1.0 | 2.0 | 1006 | 290 | 1296 | 50 | 45 | 3.0 | 2.5 |
| 486 | 19 | 2.2 | 2.5 | 1110 | 1670 | 2780 | 18.4 | 1.8 | 2.4 | 1142 | 620 | 1762 | 0 | 11 | 3.0 | 2.6 |
| 486A | 19 | 2.2 | 2.5 | 1110 | 1670 | 2780 | 19.1 | 1.6 | 2.6 | 1019 | 53 | 1072 | 50 | 11 | — | — |
| 510 | 19 | 1.1 | 5.0 | 1110 | 1670 | 2780 | 17.6 | 1.1 | 4.9 | 1120 | 210 | 1330 | 150 | 119 | 3.0 | 2.8 |
| 475 | 19 | 2.2 | 5.0 | 1110 | 1670 | 2780 | 17.5 | 2.0 | 4.8 | 1135 | 270 | 1405 | 150 | 138 | 3.0 | 2.9 |
| 475A | 19 | 2.2 | 5.0 | 1110 | 1670 | 2780 | 17.0 | 1.7 | 4.4 | 1036 | 29 | 1065 | 200 | 138 | 3.0 | 2.9 |
| B. 27%Cr Alloys | | | | | | | | | | | | | | | | |
| 504 | 27 | 1.1 | 5.0 | 56 | 83 | 139 | 26.4 | 1.0 | 4.5 | 50 | 20 | 70 | 275 | 204 | 1.5 | 1.3 |
| 504A | 27 | 1.1 | 5.0 | 56 | 83 | 139 | 26.0 | 1.1 | 4.9 | 48 | 27 | 75 | 275 | 204 | 1.0 | 1.3 |
| 519 | 27 | 1.1 | 0.8 | 556 | 824 | 1380 | 27.2 | 1.1 | 1.6 | 553 | 600 | 1153 | 0 | 39 | 1.5 | 1.9 |
| 493 | 27 | 2.2 | 0 | 556 | 824 | 1380 | 26.3 | 1.8 | — | 547 | 820 | 1367 | 100 | 91 | 1.5 | 2.5 |
| 474 | 27 | 1.1 | 2.5 | 556 | 824 | 1380 | 27.0 | 1.2 | 2.4 | 509 | 666 | 1175 | 150 | 102 | 1.0 | 1.7 |
| 496 | 27 | 1.1 | 2.5 | 556 | 824 | 1380 | 26.7 | 1.2 | 2.6 | 569 | 170 | 739 | 150 | 102 | 1.0 | 1.7 |
| 497 | 27 | 1.1 | 2.5 | 556 | 824 | 1380 | 26.9 | 1.1 | 2.5 | 552 | 220 | 772 | 150 | 102 | 1.0 | 1.7 |
| 502A | 27 | 1.1 | 2.5 | 556 | 824 | 1380 | 26.0 | 1.2 | 2.4 | 587 | 200 | 787 | 150 | 102 | 1.5 | 1.7 |
| 517 | 27 | 2.2 | 2.5 | 556 | 824 | 1380 | 26.0 | 2.2 | 2.9 | 564 | 173 | 737 | 275 | 234 | 2.0 | 2.0 |
| 477A | 27 | 2.2 | 5.0 | 556 | 824 | 1380 | 26.0 | 1.9 | 5.1 | 538 | 230 | 768 | 275 | 393 | 2.0 | 2.4 |
| 484B | 27 | 0 | 2.5 | 1110 | 1670 | 2780 | 27.6 | — | 2.4 | 1058 | 512 | 1570 | 625 | 441 | 4.0 | 4.3 |
| 495 | 27 | 0 | 2.5 | 1110 | 1670 | 2780 | 27.4 | — | 2.4 | 1040 | 150 | 1190 | 275 | 441 | 4.0 | 4.3 |
| 516 | 27 | 1.1 | 2.5 | 1110 | 1670 | 2780 | 27.2 | 0.9 | 2.3 | 1123 | 259 | 1382 | 100 | 167 | 2.0 | 2.0 |
| 522 | 27 | 2.2 | 2.5 | 1110 | 1670 | 2780 | 26.0 | 1.8 | 2.4 | 1091 | 174 | 1265 | 100 | 127 | 2.5 | 2.2 |
| 521 | 27 | 2.2 | 5.0 | 1110 | 1670 | 2780 | 26.0 | 1.8 | 4.9 | 1009 | 465 | 1474 | 275 | 282 | 2.5 | 2.4 |
| C. 35%Cr Alloys | | | | | | | | | | | | | | | | |
| 483A | 35 | 0 | 0 | 56 | 83 | 139 | 36.6 | — | — | 12 | 75 | 87 | 100 | 15 | 1.0 | 2.3 |
| 509 | 35 | 2.2 | 0 | 56 | 83 | 139 | 34.8 | 1.7 | — | 21 | 609 | 630 | 150 | 234 | 2.0 | 1.3 |
| 509A | 35 | 2.2 | 0 | 56 | 83 | 139 | 34.0 | 1.2 | — | 25 | 70 | 95 | 375 | 234 | 1.5 | 1.3 |
| 498 | 35 | 2.2 | 2.5 | 56 | 83 | 139 | 34.0 | 2.2 | 3.1 | 17 | 20 | 37 | 475 | 409 | 1.5 | 0.85 |
| 498A | | | | | | | 34.0 | 1.8 | 2.6 | 22 | 355 | 377 | 475 | 409 | 1.5 | 0.85 |
| 482 | 35 | 0 | 5.0 | 56 | 83 | 139 | 34.5 | — | 4.8 | 11 | 80 | 91 | 50 | 172 | 1.0 | 2.2 |
| 508A | 35 | 2.2 | 5.0 | 56 | 83 | 139 | | | No Analysis | | | | 625 | 600 | 1.0 | 1.2 |
| 512 | 35 | 1.1 | 0 | 556 | 824 | 1380 | 35.7 | 0.8 | — | 592 | 347 | 939 | 0 | 35 | 2.0 | 1.6 |
| 514 | 35 | 1.1 | 0.8 | 556 | 824 | 1380 | 35.3 | 1.0 | 1.0 | 583 | 395 | 978 | 75 | 71 | 1.0 | 1.3 |
| 514A | 35 | 1.1 | 0.8 | 556 | 824 | 1380 | 36.0 | 1.2 | 0.7 | 713 | 283 | 993 | 100 | 71 | 1.5 | 1.3 |
| 489 | 35 | 2.2 | 2.5 | 556 | 824 | 1380 | 34.0 | 2.2 | 2.5 | 635 | 1170 | 1805 | 200 | 280 | 1.0 | 1.4 |
| 489A | 35 | 2.2 | 2.5 | 556 | 824 | 1380 | 34.0 | 2.2 | 6.5 | 582 | 280 | 862 | 275 | 280 | 1.0 | 1.4 |
| 478 | 35 | 0 | 5.0 | 556 | 824 | 1380 | 33.4 | — | 4.2 | 558 | 300 | 858 | 275 | 344 | 4.0 | 3.2 |
| 478A | 35 | 0 | 5.0 | 556 | 824 | 1380 | 34.4 | — | 5.2 | 513 | 300 | 813 | 375 | 344 | 4.0 | 3.2 |
| 503 | 35 | 0 | 5.0 | 556 | 824 | 1380 | 34.6 | — | 5.4 | 543 | 710 | 1253 | 375 | 344 | 4.0 | 3.2 |
| 473A | 35 | 1.1 | 5.0 | 556 | 824 | 1380 | 34.4 | 1.1 | 4.6 | 620 | 229 | 849 | 375 | 289 | 1.5 | 1.3 |
| 470A | 35 | 0 | 0 | 1110 | 1670 | 2780 | 36.9 | — | — | 1084 | 577 | 1661 | 625 | 453 | 4.0 | 4.4 |
| 471 | 35 | 1.1 | 0 | 1110 | 1670 | 2780 | 36.4 | 0.8 | — | 989 | 750 | 1739 | 50 | 122 | 3.5 | 2.1 |
| 506 | 35 | 1.1 | 0 | 1110 | 1670 | 2780 | 34.9 | 0.8 | — | 954 | 410 | 1364 | 50 | 122 | 3.0 | 2.1 |
| 472 | 35 | 2.2 | 0 | 1110 | 1670 | 2780 | 34.6 | 1.9 | — | 720 | 760 | 1580 | 100 | 25 | 2.0 | 2.2 |
| 472A | 35 | 2.2 | 0 | 1110 | 1670 | 2780 | 34.7 | 1.8 | — | 863 | 290 | 1153 | 50 | 25 | 1.5 | 2.2 |
| 476 | 35 | 1.1 | 2.5 | 1110 | 1670 | 2780 | 35.1 | 1.2 | 2.5 | 1107 | 538 | 1645 | 200 | 237 | 1.0 | 1.5 |
| 479 | 35 | 2.2 | 2.5 | 1110 | 1670 | 2780 | 34.0 | 2.0 | 2.8 | 1129 | 428 | 1557 | 150 | 192 | 1.5 | 1.6 |
| 500 | 35 | 2.2 | 2.5 | 1110 | 1670 | 2780 | 33.7 | 2.1 | 3.1 | 1010 | 590 | 1600 | 200 | 192 | 1.5 | 1.6 |
| 480 | 35 | 0 | 5.0 | 1110 | 1670 | 2780 | 36.0 | — | 4.6 | 955 | 802 | 1757 | 625 | 595 | 3.0 | 3.9 |
| 480A | 35 | 0 | 5.0 | 1110 | 1670 | 2780 | 34.9 | — | 5.5 | 1005 | 230 | 1235 | 625 | 595 | 4.0 | 3.9 |
| 480B | 35 | 0 | 5.0 | 1110 | 1670 | 2780 | 35.1 | — | 6.0 | 1069 | 543 | 1612 | 625 | 595 | 4.0 | 3.9 |
| 491 | 35 | 1.1 | 5.0 | 1110 | 1670 | 2780 | 34.0 | 1.1 | 5.5 | 1167 | 400 | 1567 | 275 | 369 | 1.5 | 1.6 |
| 492 | 35 | 2.2 | 5.0 | 1110 | 1670 | 2780 | 33.1 | 1.8 | 5.1 | 1154 | 630 | 1784 | 375 | 377 | 1.5 | 1.7 |
| 494 | 35 | 2.2 | 5.0 | 1110 | 1670 | 2780 | 33.4 | 1.6 | 4.4 | 1151 | 370 | 1521 | 375 | 377 | 2.0 | 1.7 |
| 505 | 35 | 2.2 | 5.0 | 1110 | 1670 | 2780 | 33.0 | 1.8 | 5.3 | 1005 | 350 | 1355 | 375 | 377 | 2.0 | 1.7 |
| 507 | 35 | 2.2 | 5.0 | 1110 | 1670 | 2780 | 33.0 | 2.0 | 4.8 | 994 | 350 | 1344 | 375 | 377 | 1.5 | 1.7 |

[1]BDTT — Brittle to ductile transition temperature of welded sample.

TABLE II-B

COMPILATION OF ALLOY COMPOSITIONS AND EXPERIMENTAL AND PREDICTED VALUES FOR POST-WELD DUCTILITY AND CORROSION RESISTANCE — PART II

| | Charged | | | | | | Analyzed | | | | | | | | | |
|---|---|---|---|---|---|---|---|---|---|---|---|---|---|---|---|---|
| | wt% | | | ppm | | | wt% | | | ppm | | | BDTT°F[1] | | Corrosion Rating | |
| Alloy No: | Cr | Ti | Al | C | N | C+N | Cr | Ti | Al | C | N | C+N | Measured | Predicted | Measured | Predicted |
| 537 | 35 | 0.1 | 0.1 | 56 | 83 | 139 | 35.6 | 0.1 | 0.3 | 16 | 34 | 50 | −75 | 8.0 | 1.0 | 2.0 |
| 538 | 35 | 0.1 | 0.1 | 56 | 83 | 139 | 35.7 | 0.1 | 0.3 | 16 | 20 | 36 | −75 | 8.0 | 1.0 | 2.0 |
| 539 | 35 | 0.1 | 0.1 | 56 | 83 | 139 | 36.2 | 0.1 | 0.2 | 19 | 20 | 39 | −50 | 8.0 | 1.0 | 2.0 |
| 540 | 35 | 1.0 | 0 | 250 | 250 | 500 | 35.7 | 0.8 | 0 | 263 | 15 | 278 | −50 | 5.2 | 1.0 | 1.0 |
| 540A | 35 | 1.0 | 0 | 250 | 250 | 500 | — | — | — | 370 | 15 | 385 | −50 | 5.2 | 1.0 | 1.0 |

TABLE II-B-continued

COMPILATION OF ALLOY COMPOSITIONS AND EXPERIMENTAL AND PREDICTED VALUES FOR POST-WELD DUCTILITY AND CORROSION RESISTANCE — PART II

| | Charged | | | | | | Analyzed | | | | | | | | | |
|---|---|---|---|---|---|---|---|---|---|---|---|---|---|---|---|---|
| | wt% | | | ppm | | | wt% | | | ppm | | | BDTT°F[1] | | Corrosion Rating | |
| Alloy No. | Cr | Ti | Al | C | N | C+N | Cr | Ti | Al | C | N | C+N | Measured | Predicted | Measured | Predicted |
| 541 | 28 | 0 | 0 | 250 | 250 | 500 | 29.5 | 0 | 0 | 248 | 345 | 593 | 50 | 51 | 4.0 | 3.2 |
| 541A | 28 | 0 | 0 | 250 | 250 | 500 | — | — | — | 294 | 263 | 557 | 50 | 51 | 4.0 | 3.2 |
| 542 | 29 | 1.0 | 1.0 | 250 | 250 | 500 | 28.8 | 0.9 | 1.1 | 272 | 376 | 648 | 0 | 37 | 1.5 | 1.2 |
| 543 | 27 | 0 | 1.0 | 250 | 250 | 500 | 26.5 | 0 | 1.2 | 248 | 252 | 500 | 0 | 61 | 4.0 | 3.1 |
| 544 | 19 | 0 | 0.5 | 250 | 250 | 500 | 18.1 | 0 | 0.3 | 95 | 246 | 341 | 25 | −20 | 4.0 | 3.6 |
| 545 | 35 | 0 | 0.4 | 250 | 250 | 500 | 36.7 | 0 | 0.6 | 271 | 350 | 621 | 200 | 73 | 4.0 | 2.6 |
| 546B | 27 | 1.0 | 0 | 400 | 400 | 800 | 27.4 | — | — | 638 | 7 | 645 | −50 | −2 | 1.5 | 1.8 |
| 547 | 27 | 1.0 | 0.5 | 400 | 400 | 800 | 27.1 | 1.0 | 0.8 | 391 | 350 | 741 | −50 | 14 | 1.5 | 1.7 |
| 550 | 19 | 0 | 0 | 250 | 250 | 500 | — | — | — | 140 | 250 | 390 | 0 | 21 | 4.0 | 3.8 |
| 550A | 19 | 0 | 0 | 250 | 250 | 500 | — | — | — | 127 | 265 | 392 | 50 | 21 | 4.0 | 3.8 |
| 551 | 28 | 0 | 0.5 | 250 | 250 | 500 | — | — | — | 333 | 260 | 593 | 100 | 59 | 4.0 | 3.1 |
| 552 | 28 | 0 | 0.5 | 100 | 100 | 200 | — | — | — | 104 | 149 | 253 | 50 | 23 | 4.0 | 2.8 |

[1]BDTT — Brittle to ductile transition temperature of welded sample.

Referring to the FIGURES, each consists of a series of plots of "iso-chromium" curves, i.e., each curve is reserved for the denoted weight percent of chromium labeled, extending over the range 19% to 35% at 2% intervals, running in order of increasing C+N contents in sequence from A,A′ through J,H′ inclusive (except FIGS. 5 and 5′ which run through F and C′, respectively, only). The ordinates prescribe titanium contents in weight percent to a maximum of 2.2%, whereas the abscissas prescribe aluminum contents in weight percent to a maximum of 5%. The plots A to J, or pro rata for plot F, FIG. 5, contain progressively greater amounts of C+N extending from about 139 ppm for plots A to a maximum of about 2780 ppm for plots J. The plots A′ start at 139 ppm of C+N and extend to 1500 ppm for FIGS. 1′ through 4′, inclusive, but only to 500 ppm for FIG. 5′C′.

Applicant's research results showed that most of his samples having measured desirable properties fall within the concave side of the applicable curve, whereas most of his samples having undesirable properties fall beyond the convex side.

Applicant's research shows that for compositions within the concave portions of the individual curves one obtains the desirable properties to which the several FIGURES relate, i.e., FIGS. 1 and 1′ alloys possess post-weld ductility at room temperature (75° F.); some compositions will actually have post-weld ductility below room temperature. In FIGS. 11A, 1′A′, 1B, 1′B′, 1C, 1′C′, 3′A′ and 4′A′ materials containing 29–35% Cr are ductile to the right of the short lines labelled "29–35". FIGS. 2 and 2′ alloy compositions possess post-weld corrosion resistance ratings of 2.0 or below, as hereinbefore described in Section 4(c). FIGS. 3 and 3′, which are composites of FIGS. 1 and 2, and FIGS. 1′ and 2′, respectively, show alloy compositions within the concave portions of the curves joined or associated with one another, or within the areas of any curve totally closed, which possess both post-weld ductility at 75° F., or sometimes at even lower temperatures, and corrosion resistance also. FIGS. 4 and 4′ show alloy compositions of FIGS. 1 and 1′, respectively, that possess post-weld ductility at 0° F., and FIGS. 5 and 5′, which are composites of FIGS. 2 and 4, and FIGS. 2′ and 4′, respectively, show alloy compositions within the concave portions of the curves joined or associated one with another, or within the areas of any curve totally enclosed, which possess both post-weld ductility at 0° F. and corrosion resistance also.

Figure 5A:
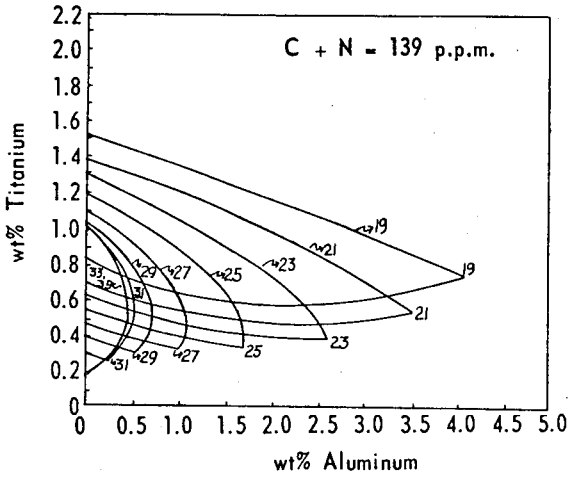
Figure 5B:
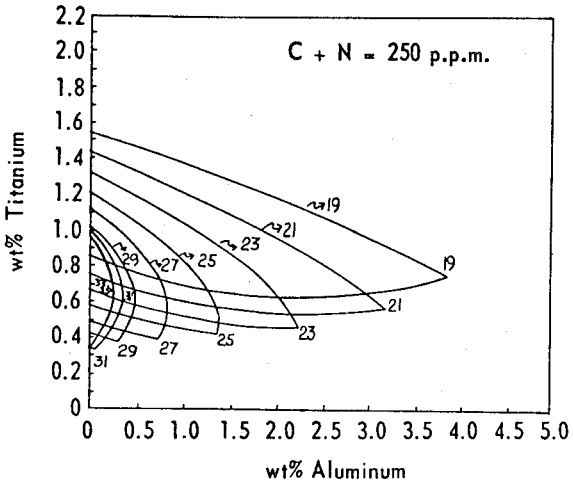
Figure 5C:
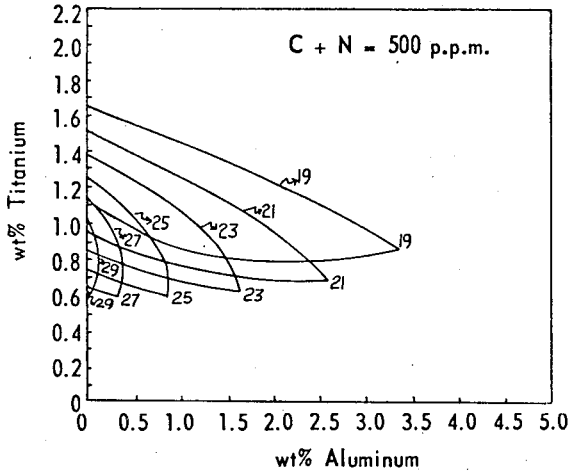
Figure 5D:
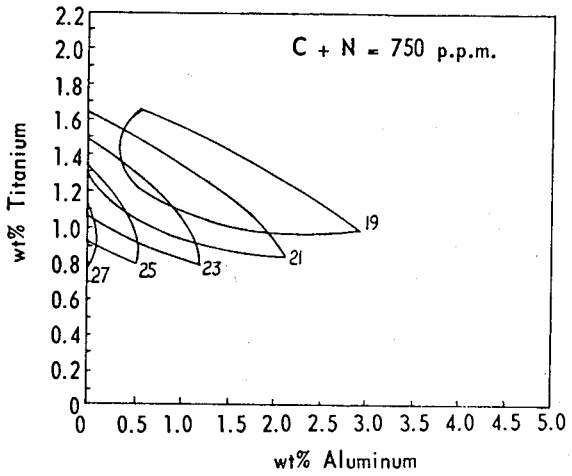
Figure 5E:
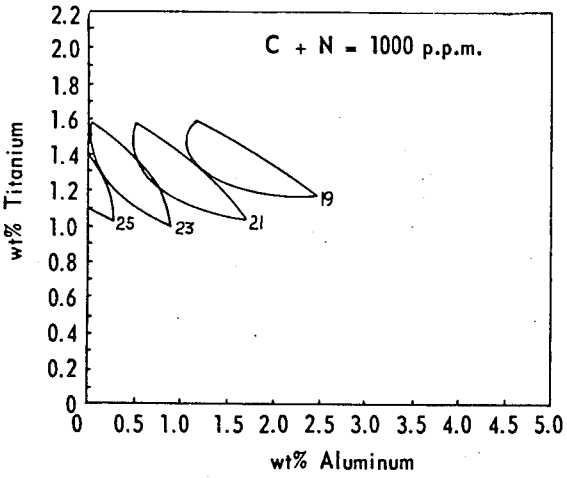
Figure 5F:
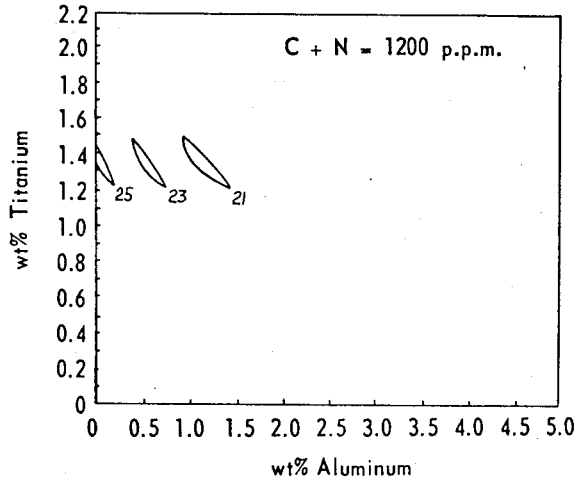
Figure 1A:
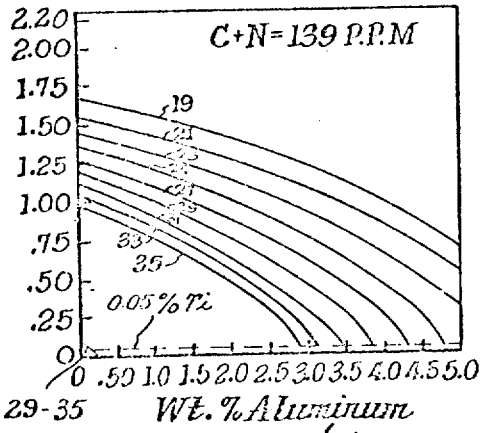
Figure 1B:
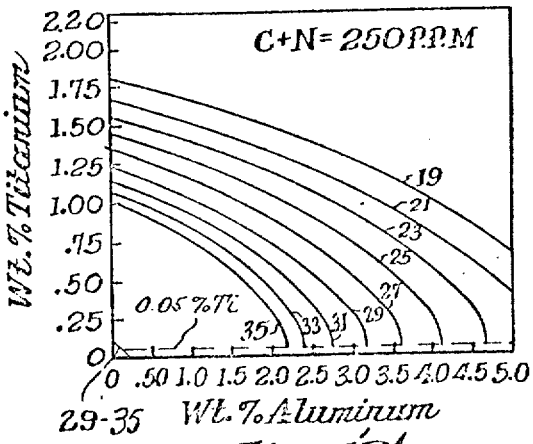
Figure 1C:
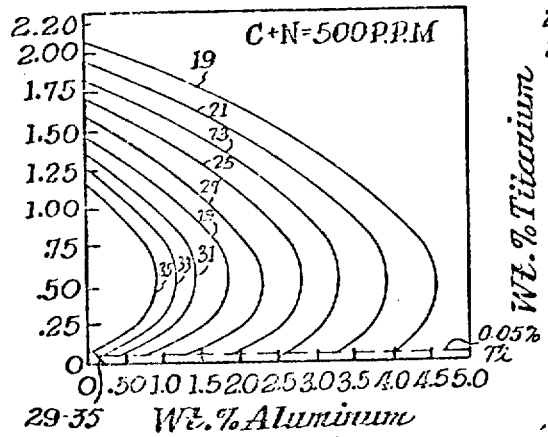
Figure 1D:
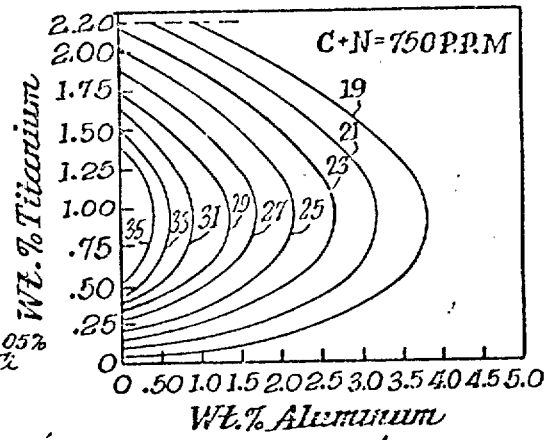
Figure 1E:
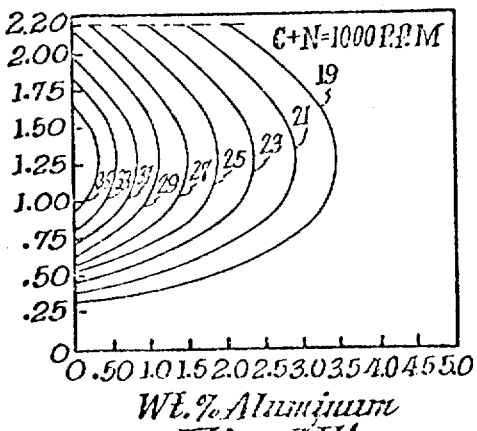
Figure 1F:
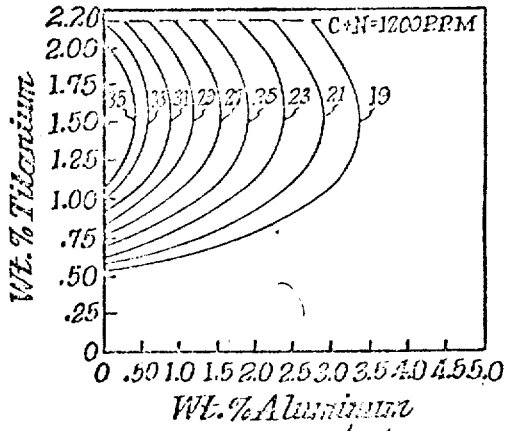
Figure 1G:
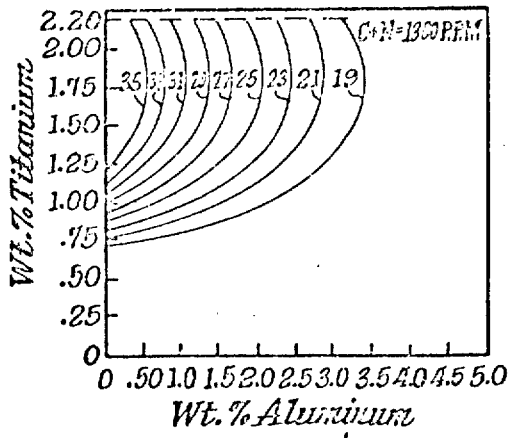
Figure 1H:
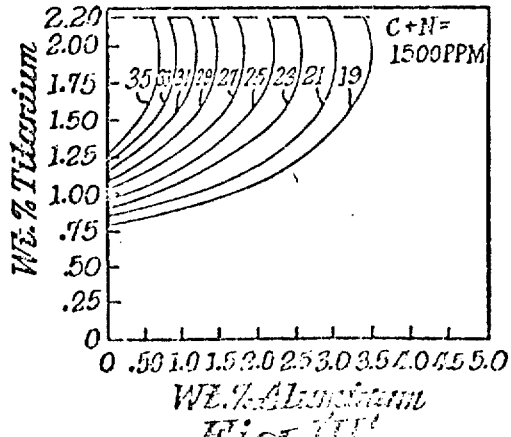
Figure 2A:
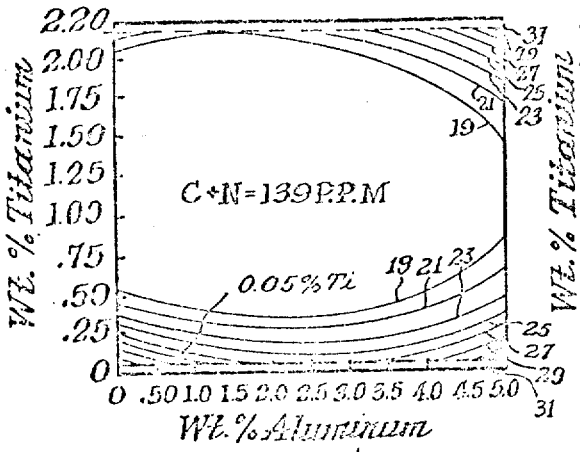
Figure 2B:
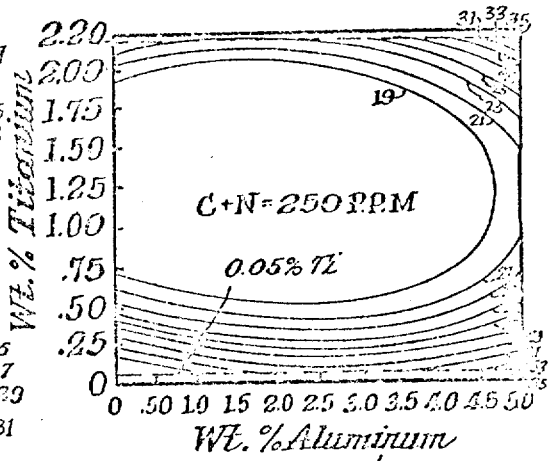
Figure 2C:
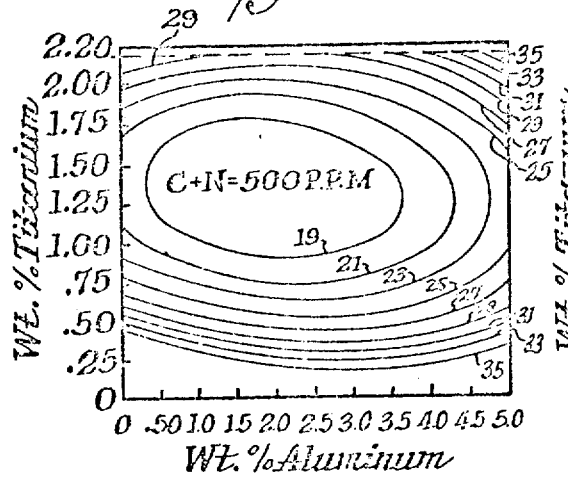
Figure 2D:
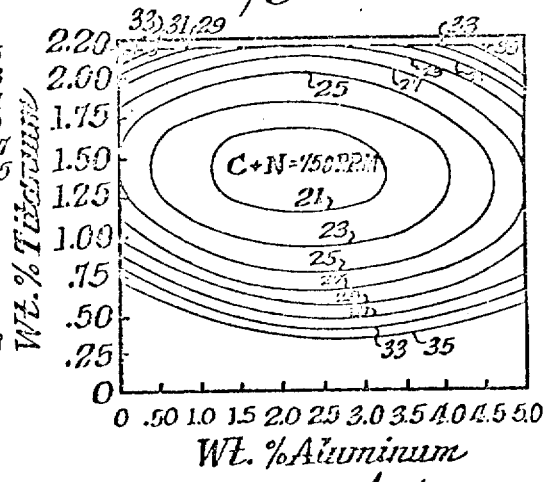
Figure 2E:
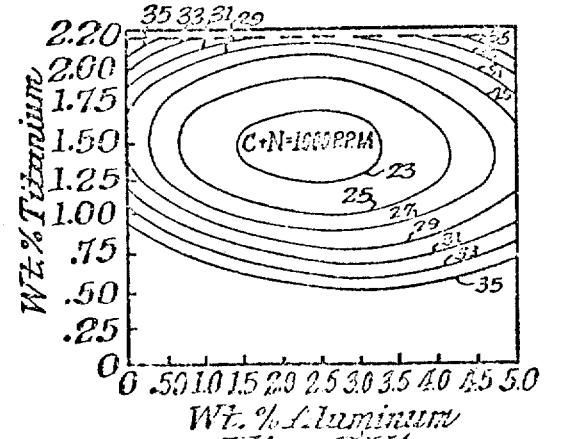
Figure 2F:
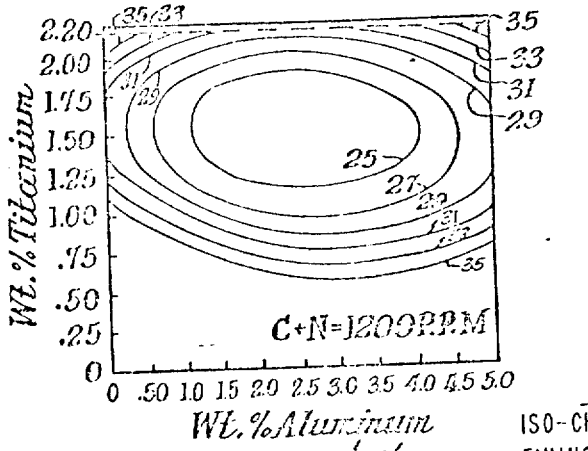
Figure 2G:
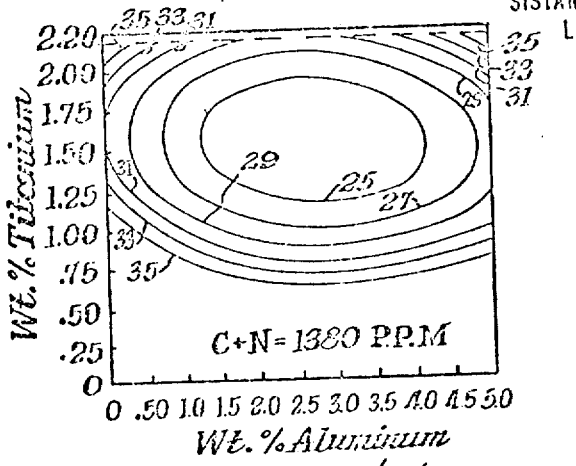
Figure 2H:
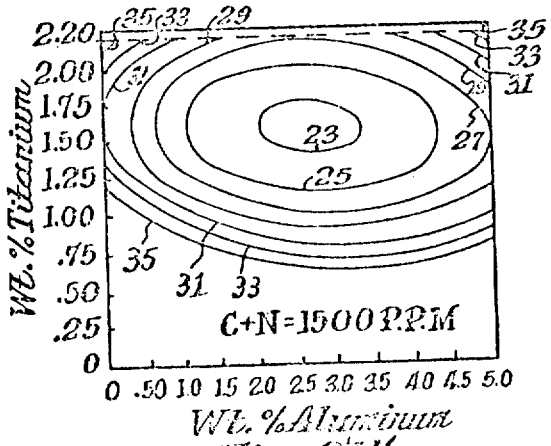
Figure 3A:
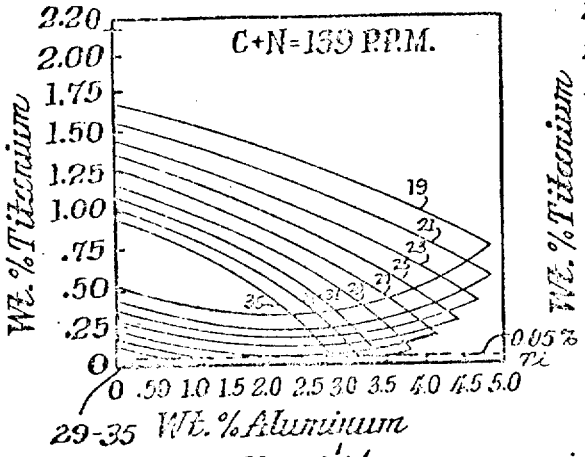
Figure 3B:
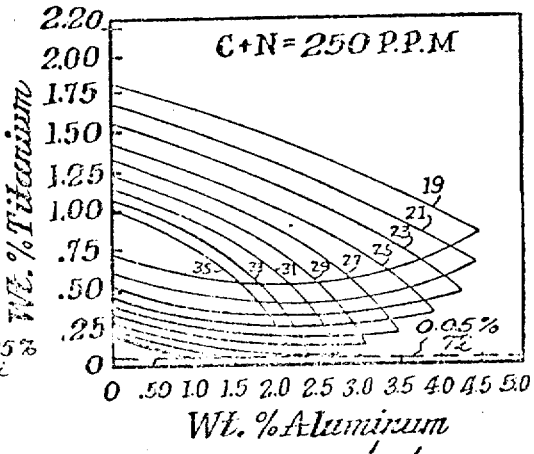
Figure 3C:
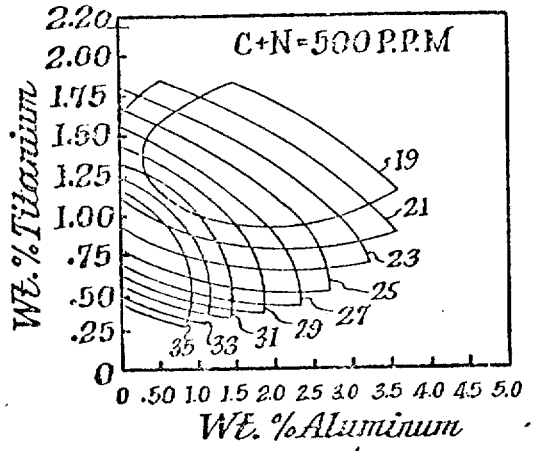
Figure 3D:
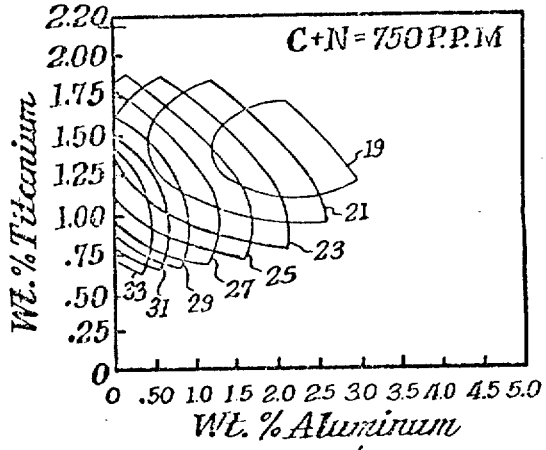
Figure 3E:
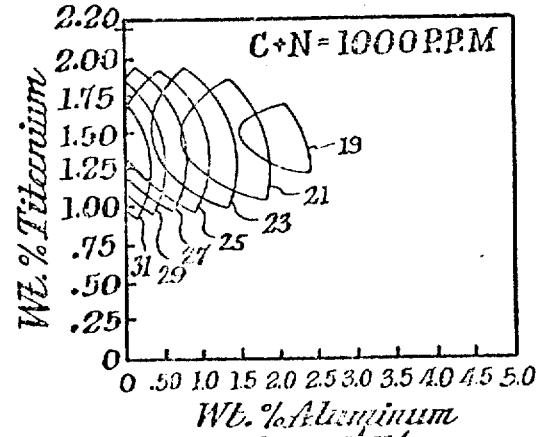
Figure 3F:
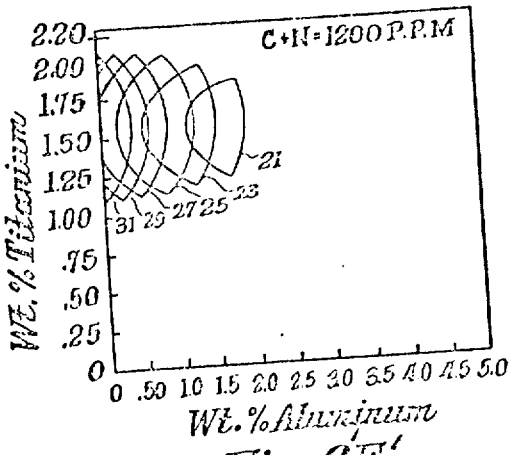
Figure 3G:
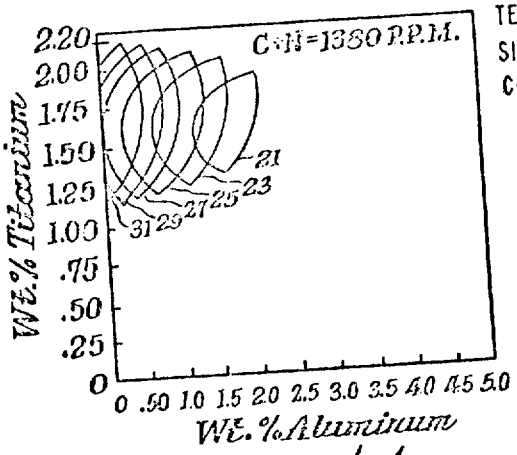
Figure 3H:
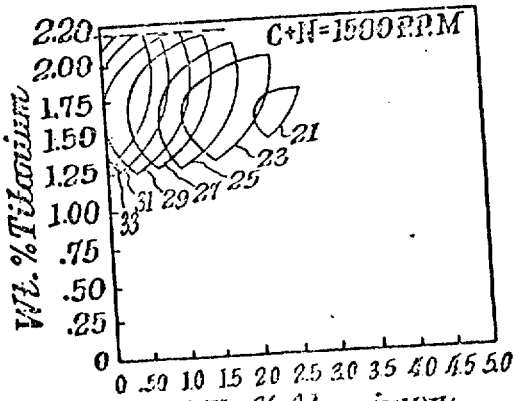
Figure 4A:
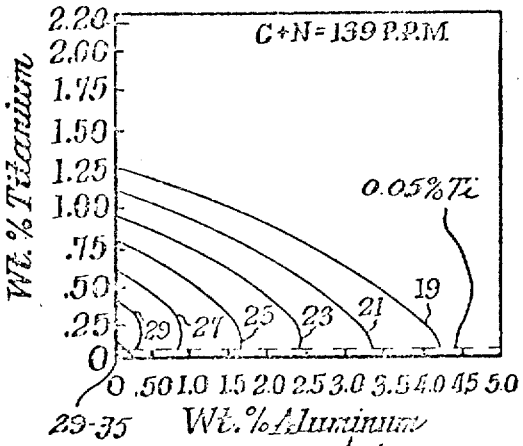
Figure 4B:
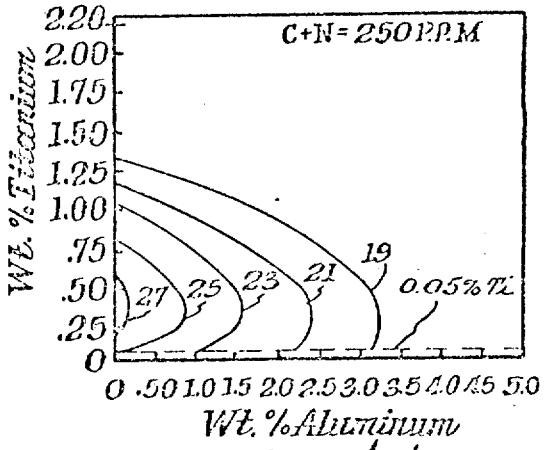
Figure 4C:
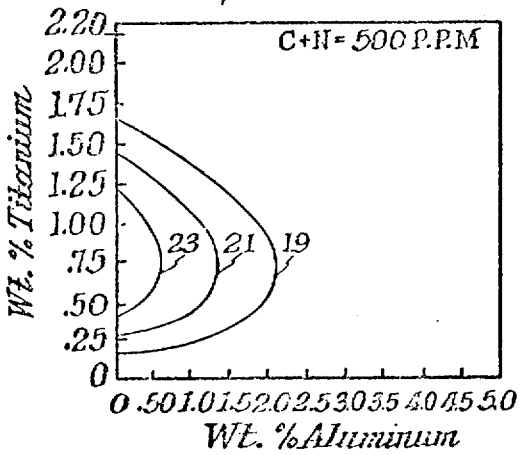
Figure 4D:
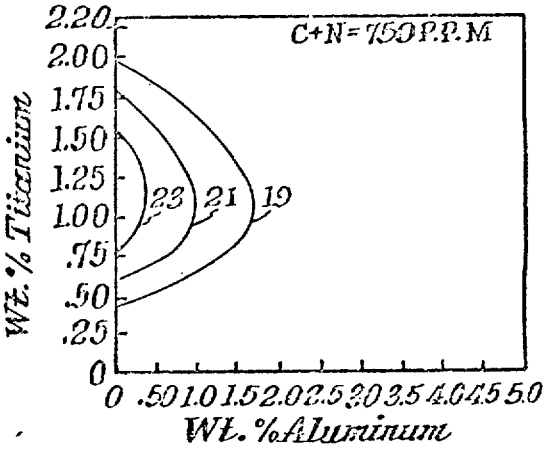
Figure 4E:
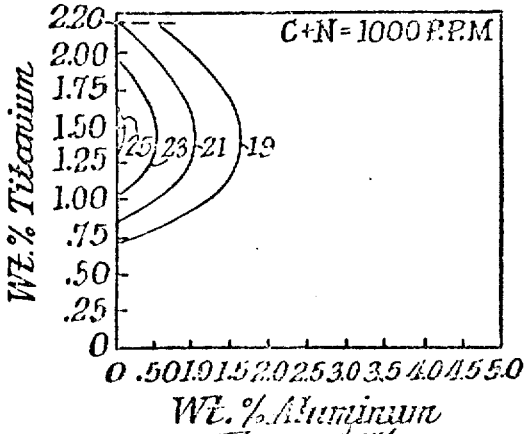
Figure 4F:
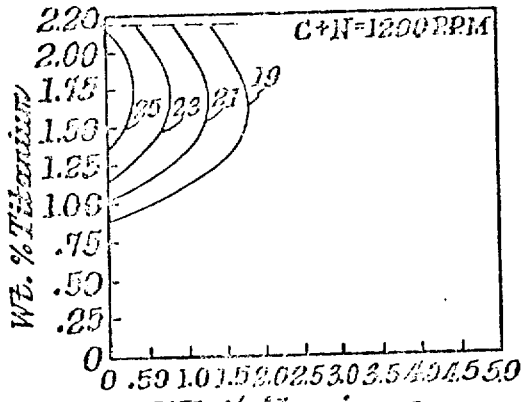
Figure 4G:
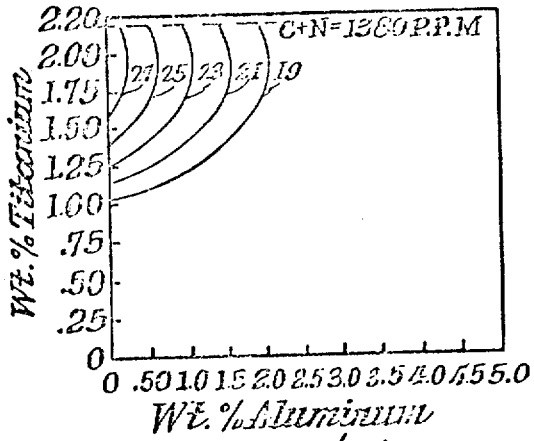
Figure 4H:
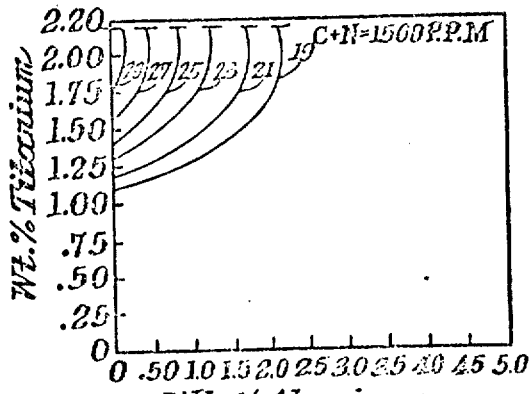
Figure 5A:
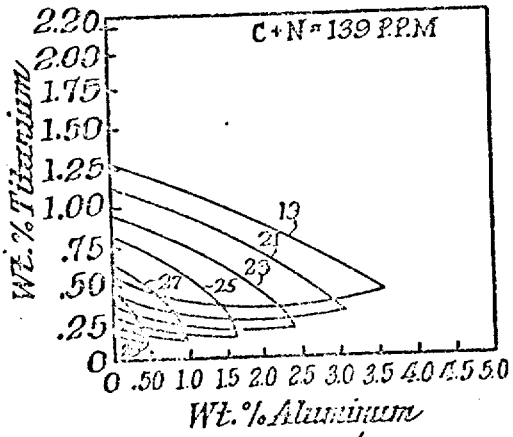
Figure 5B:
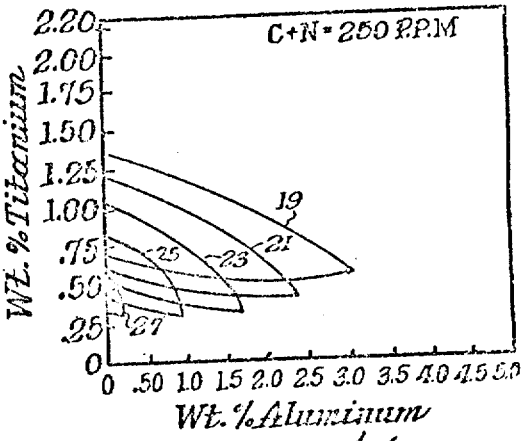
Figure 5C:
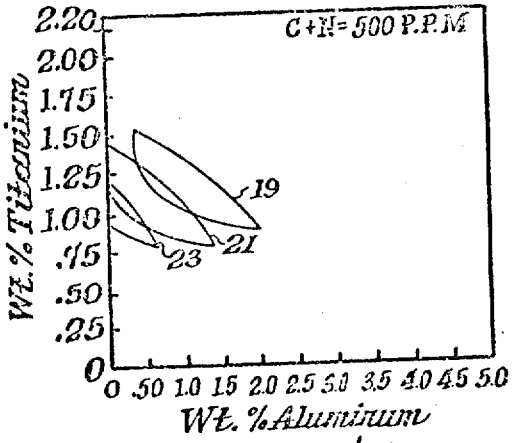
Figure 2C:
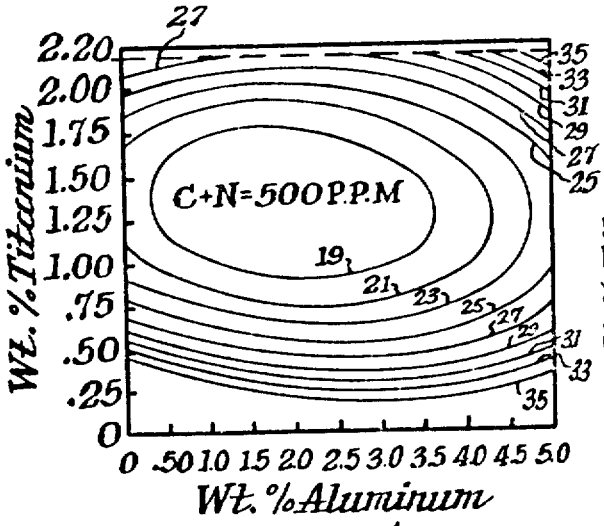
Figure 2D:
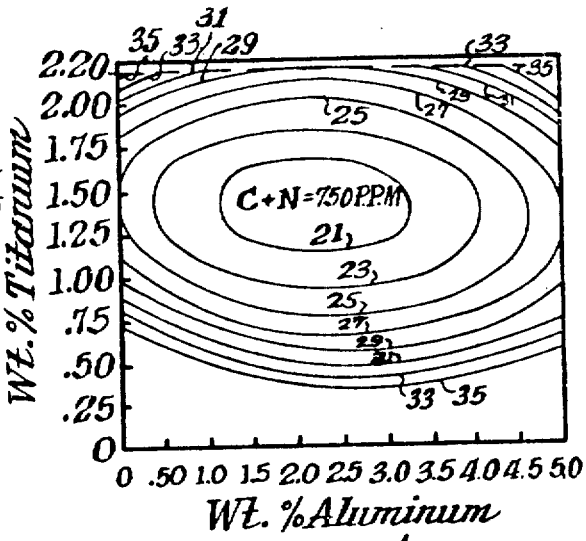
Figure 3D:
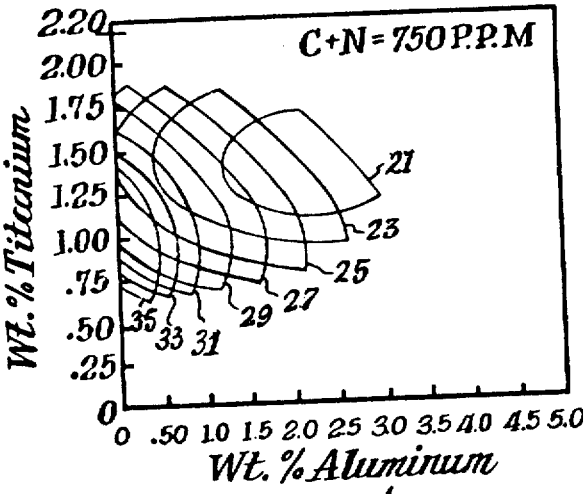
Figure 3E:
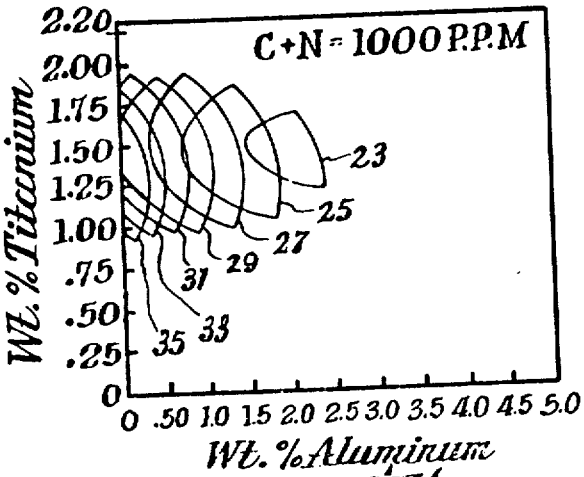
Figure 3F:
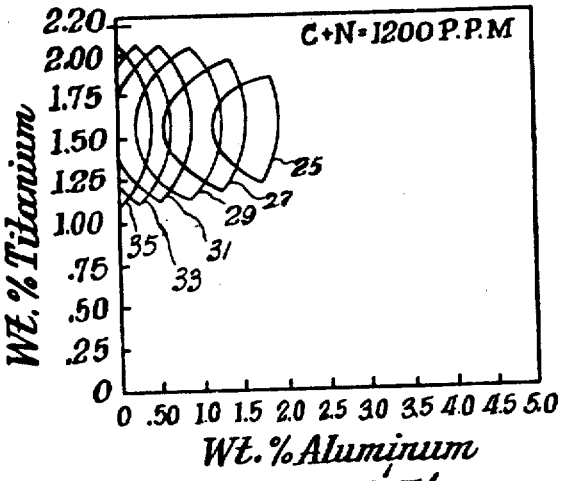
Figure 3G:
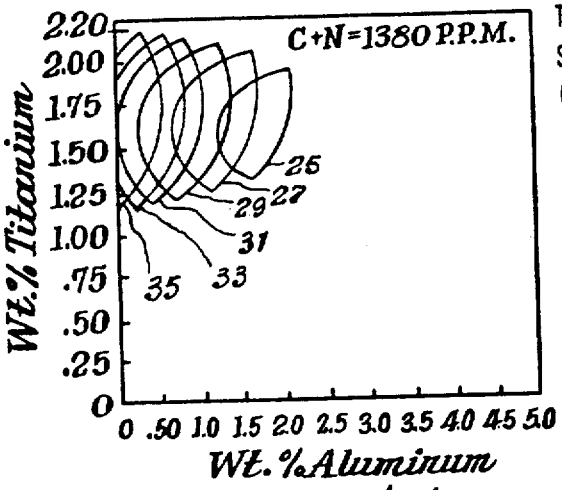
Figure 3H:
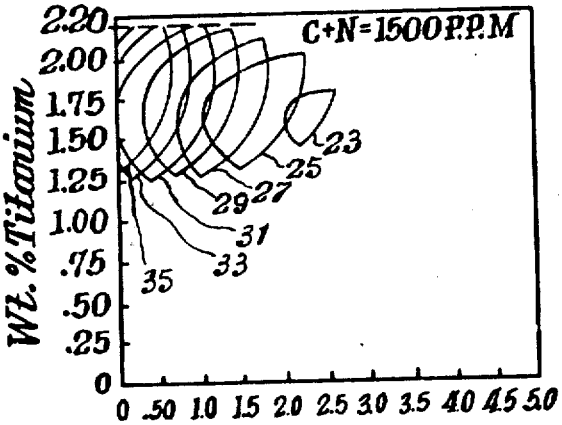

It will be noted that there occurs a marked diminution of acceptable alloy compositions in going from relatively low to relatively high C+N contents, FIG. 5F, for C+N = 1200 ppm, for example, showing acceptable compositions only for chromium contents of 21 and 23 weight percent and a small region at 25 weight percent, whereas FIG. 5′C′, for C+N = 500 ppm, shows acceptable compositions only for chromium contents of 19, 21 and a very small region of 23% Cr.

Essential Ti and Al contents of intervening chromium content alloys are determined, to a close approximation, by interpolation along normals drawn to either one of a given pair of adjacent iso-chromium curves. Similarly, essential Ti and Al contents for intervening C+N contents of the alloys of this invention are determined, to a close approximation, by linear interpolation from the ordinate and abscissa axes of a given pair of adjacent plots for a preselected iso-chromium value.

Figure 1C:
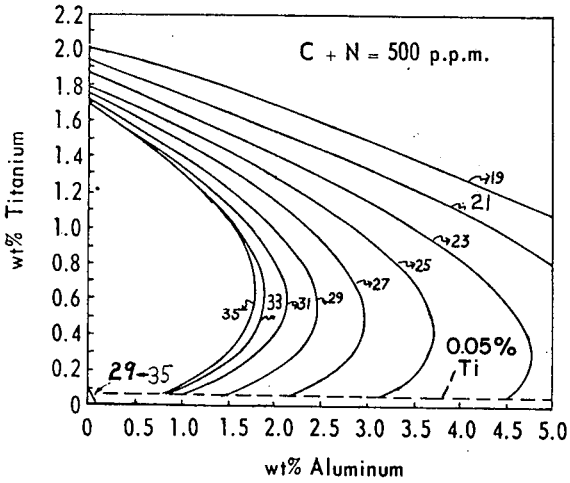

Using FIGS. 1C and 1D as an example, assuming that an as charged content of 2 weight percent of Al was desired in a 25 wt. percent chromium alloy having a C+N content of 600 ppm, the permissible Ti contents fall within a range determined as follows:

Reading FIG. 1C, at 2.0% Al, 25% Cr, the graphed span of Ti contents is found to be in the range 0 to 1.30 weight percent.

Figure 1D:
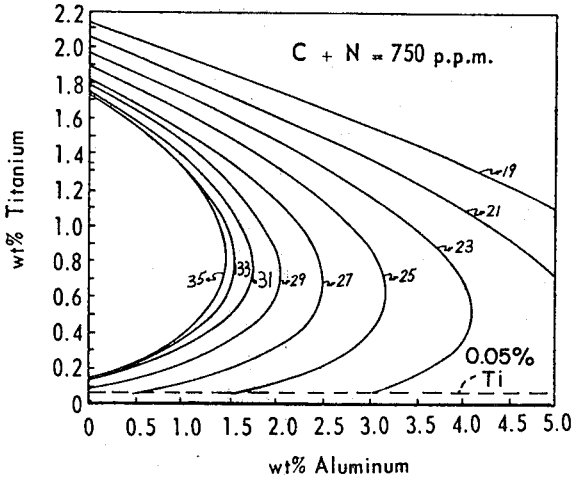
Figure 1E:
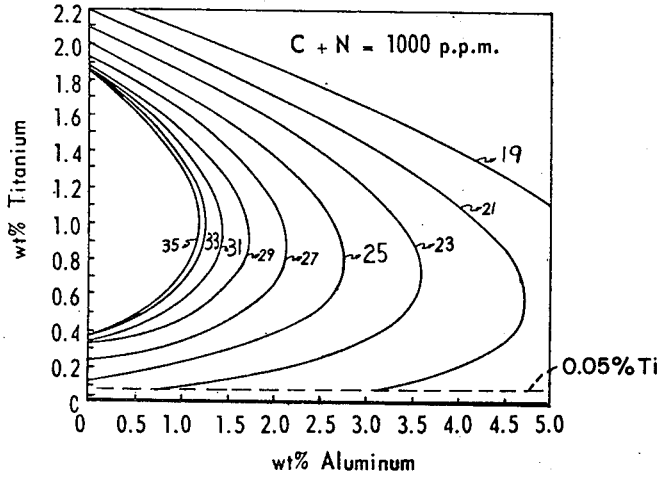
Figure 1F:
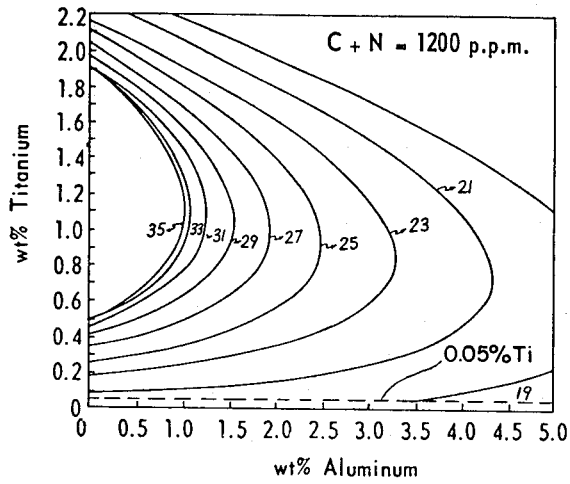
Figure 1G:
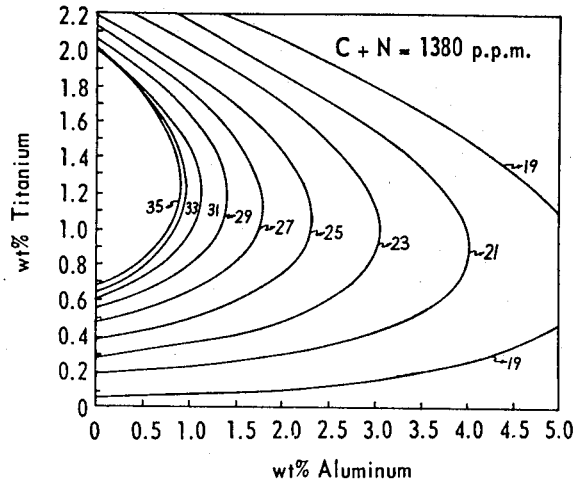
Figure 1H:
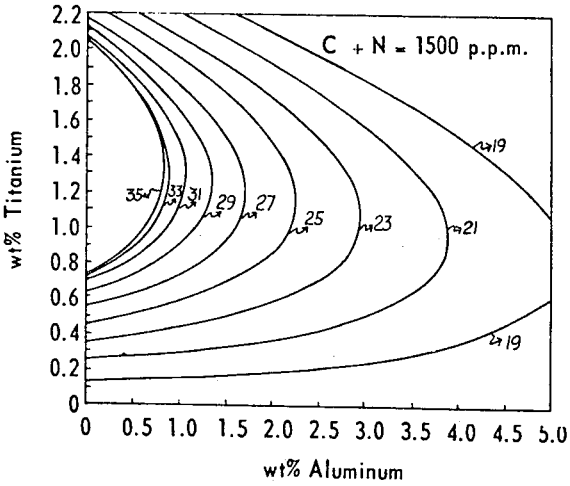
Figure 1I:
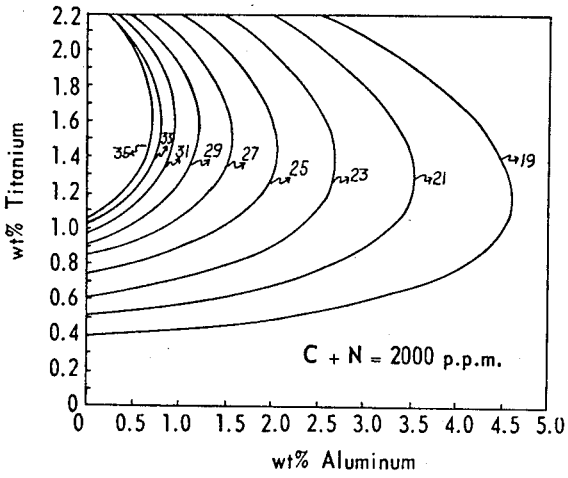
Figure 1J:
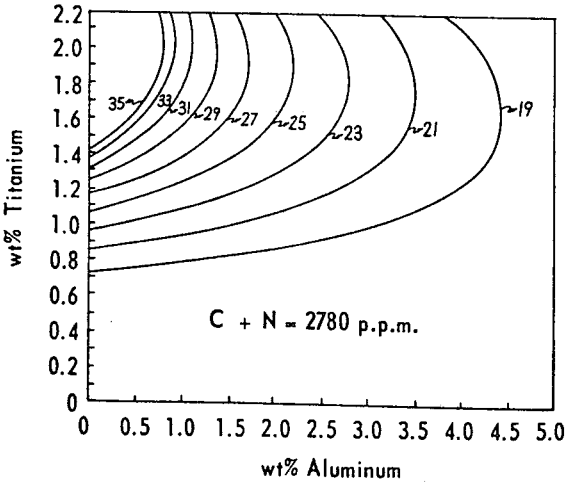
Figure 2A:
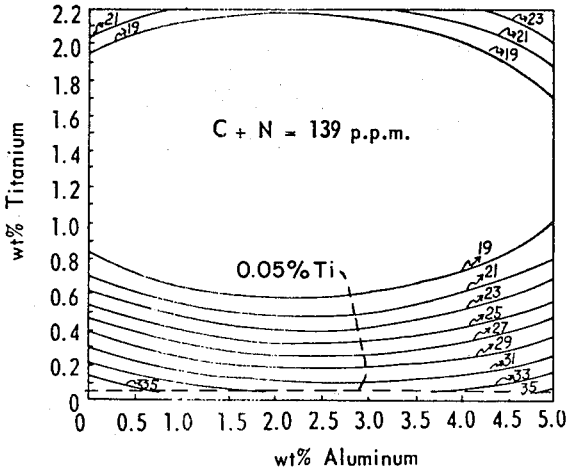
Figure 2B:
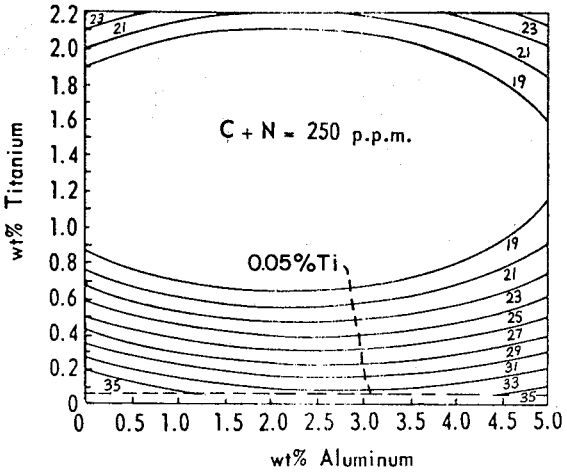
Figure 2C:
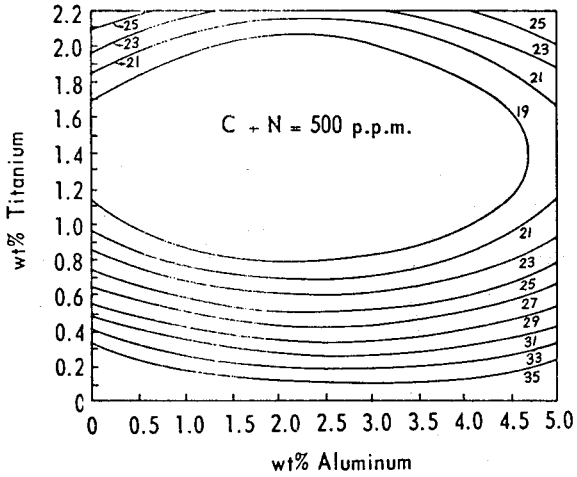
Figure 2D:
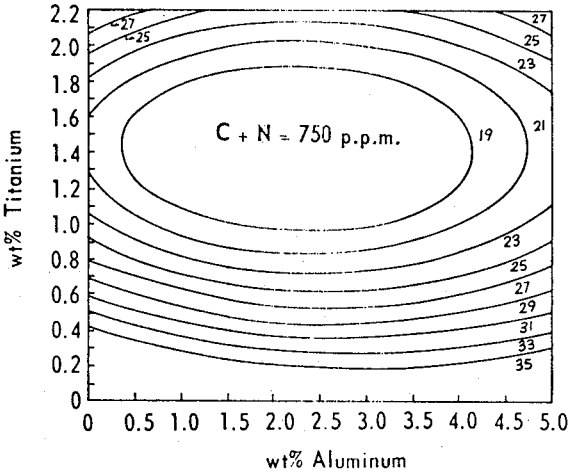
Figure 2E:
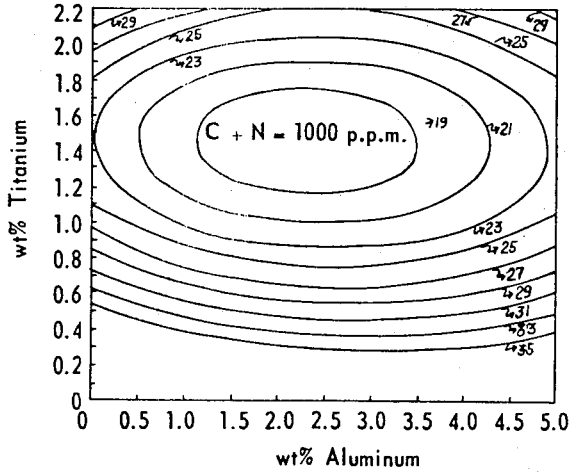
Figure 2F:
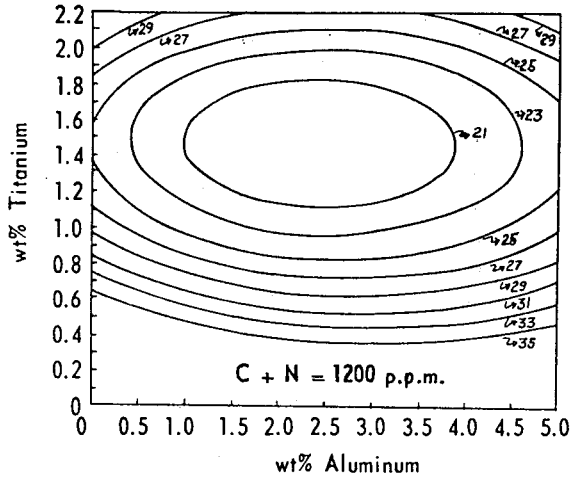
Figure 2G:
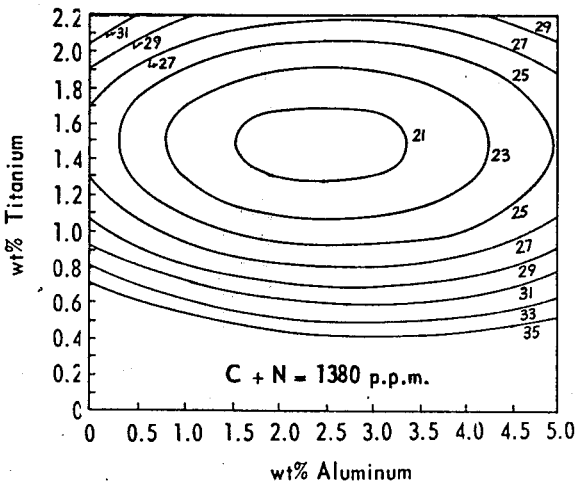
Figure 2H:
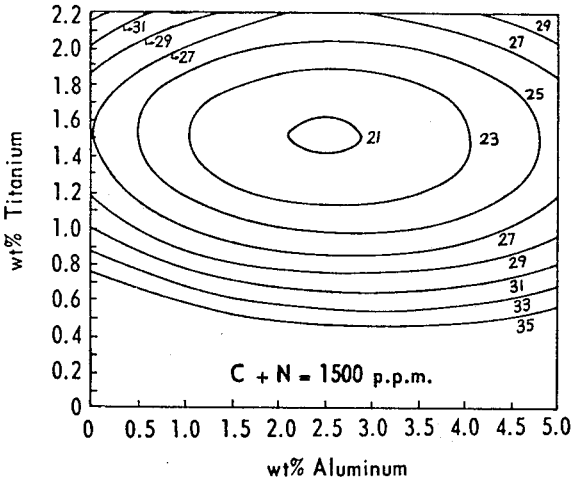
Figure 2I:
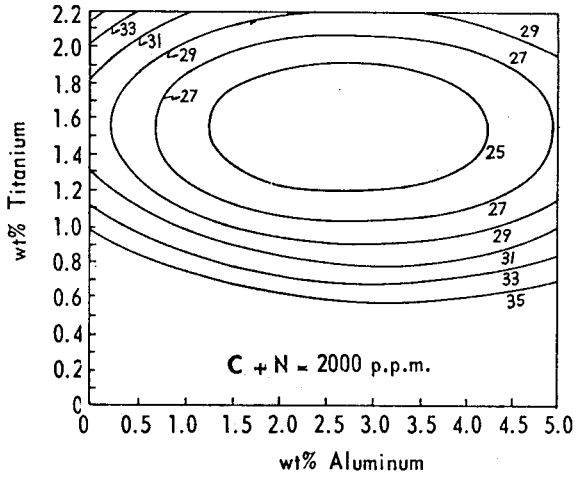
Figure 2J:
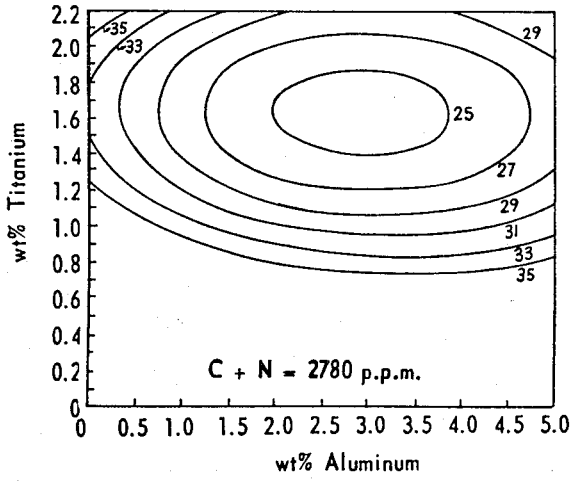
Figure 3A:
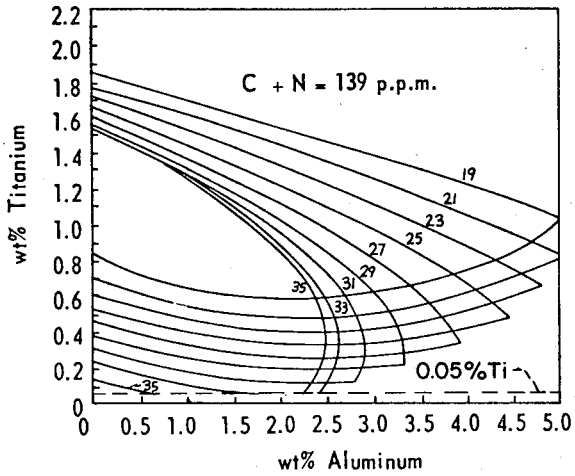
Figure 3B:
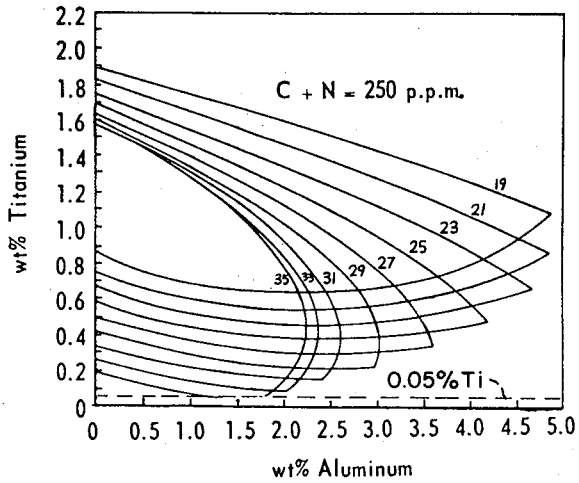
Figure 3C:
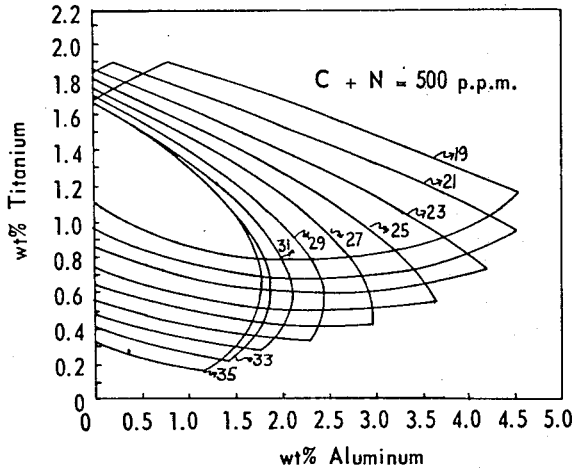
Figure 3D:
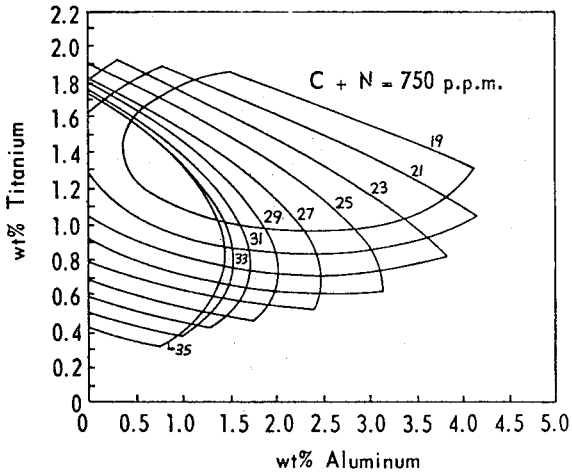
Figure 3E:
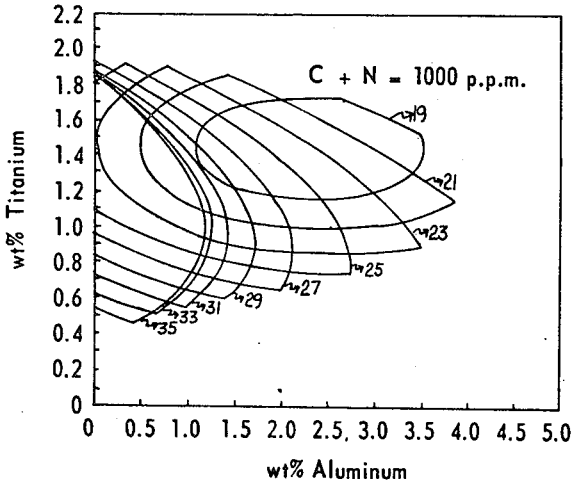
Figure 3F:
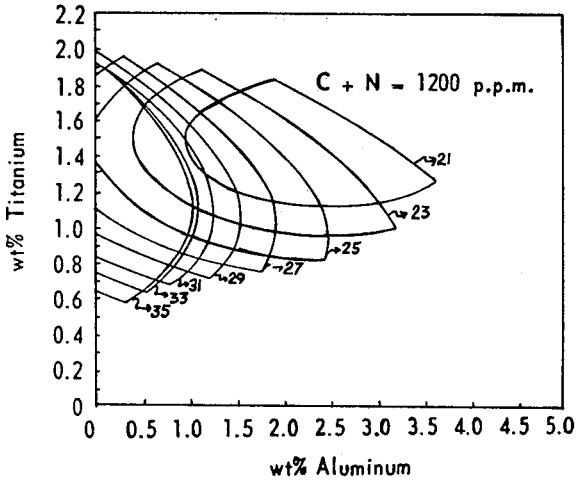
Figure 3G:
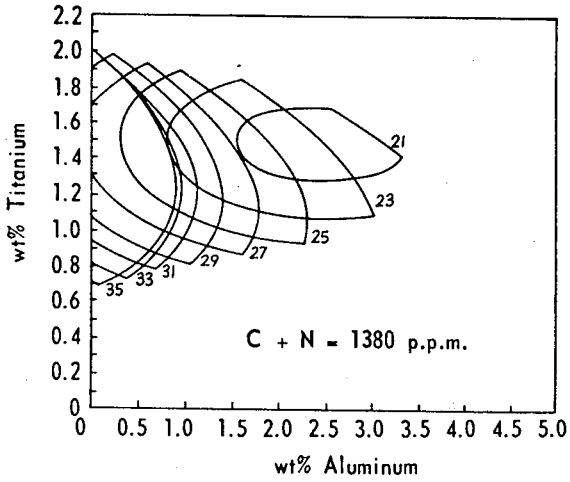
Figure 3H:
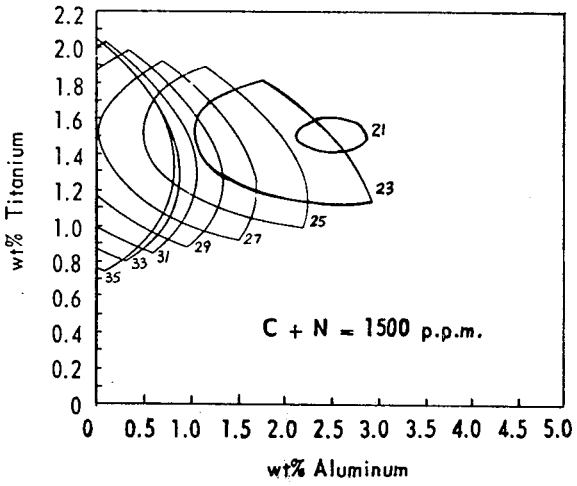
Figure 3I:
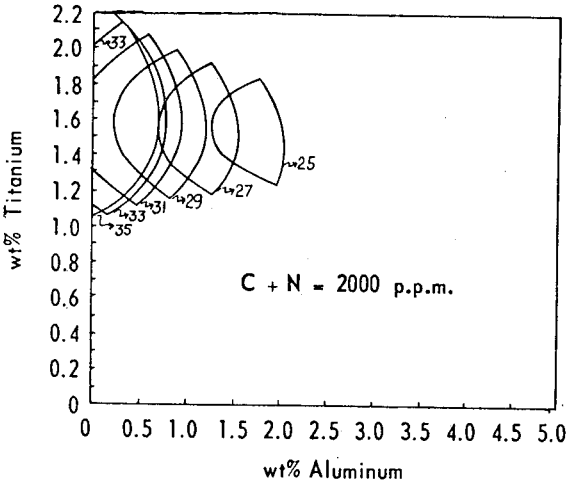
Figure 3J:
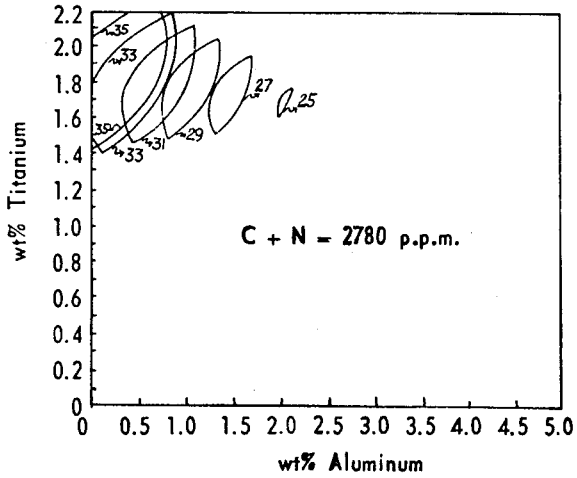
Figure 4A:
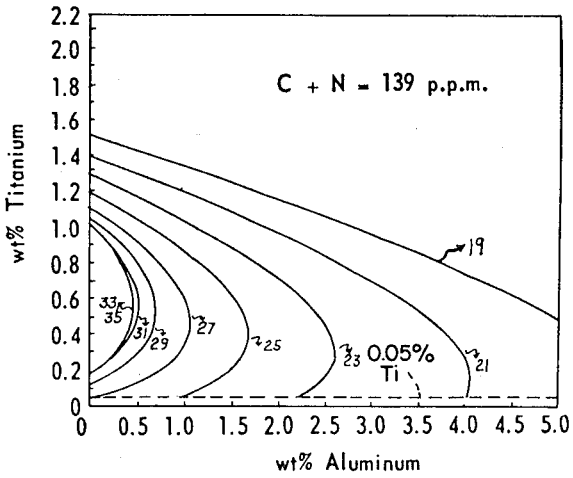
Figure 4B:
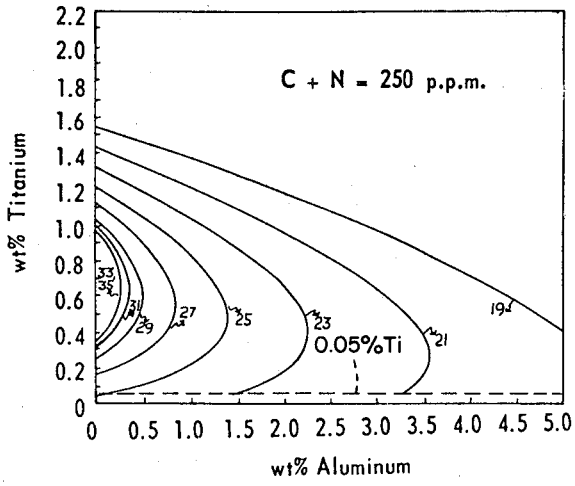
Figure 4C:
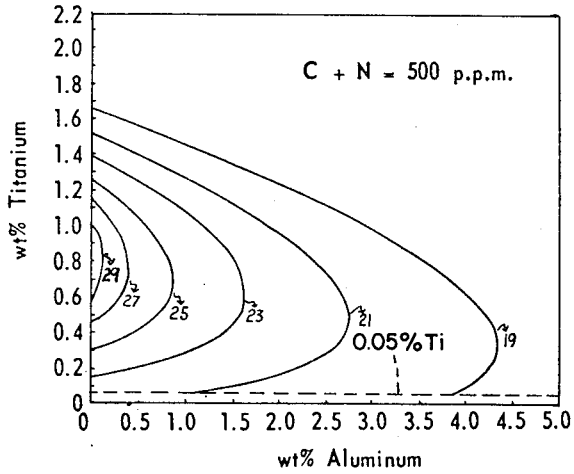
Figure 4D:
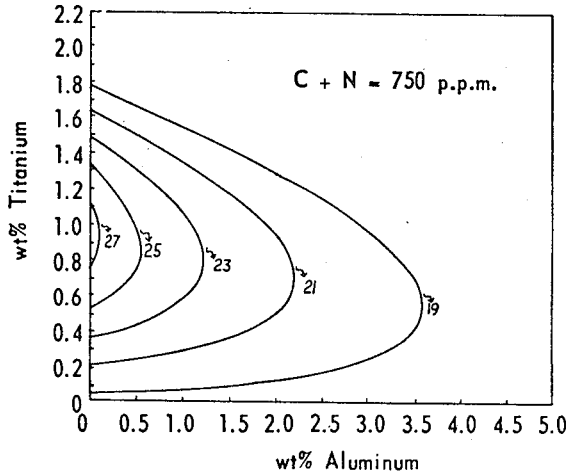
Figure 4E:
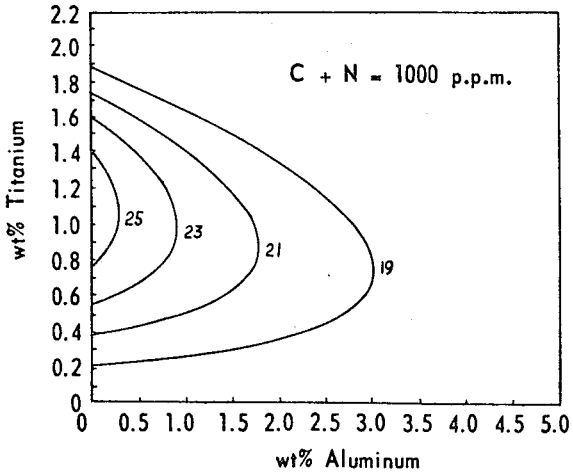
Figure 4F:
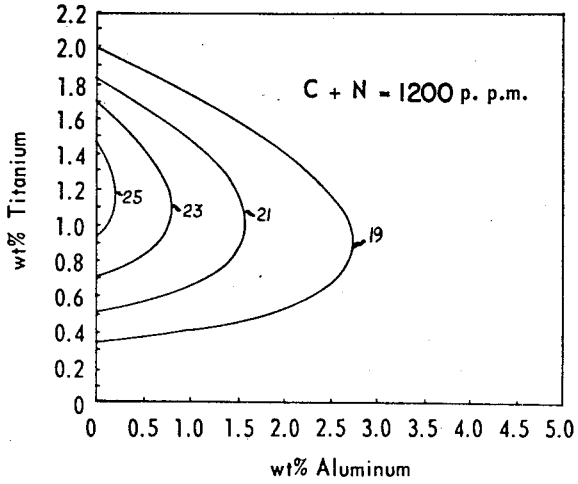
Figure 4G:
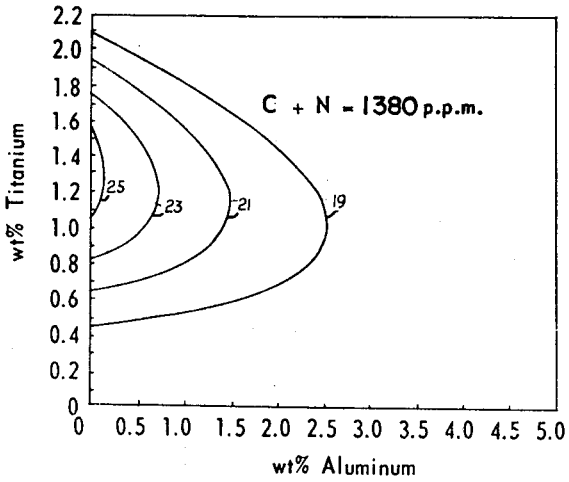
Figure 4H:
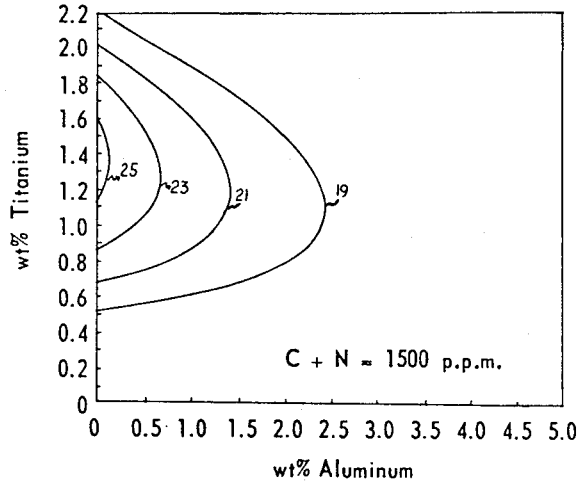
Figure 4I:
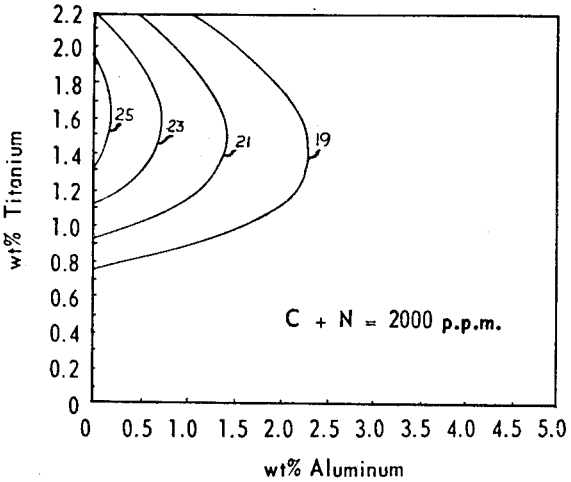
Figure 4J:
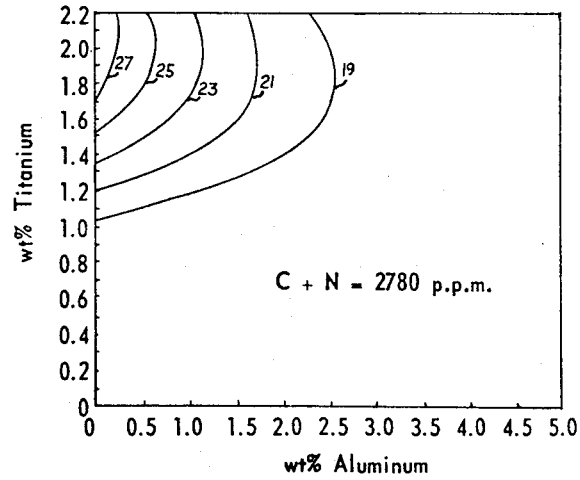

Reading FIG. 1D, at 2.0% Al, 25% Cr, the graphed span of Ti contents is found to be in the range 0.12 to 1.33 weight percent.

Then, $(600\text{-}500)/(750\text{-}500) \times (0.12\text{-}0) = 0.048$, rounded to 0.05% (which fortuitously conforms with the governing 0.05% Ti minimum hereinbefore set), which is the incremental Ti percent to be added to the 0% lower limit at 500 ppm, whereas $(600\text{-}500)/(750\text{-}500) \times (1.33\text{-}1.30) = 0.012$ rounded to 0.01, which is the incremental Ti percent to be added to the 1.30 upper limit at 500 ppm, so that the resulting permissible Ti range for 25 weight percent Cr and 2% Al at 600 ppm is 0.05–1.31 weight percent (as charged).

Alternatively, of course, the foregoing values can be computed by use of the applicable quadratic equation, supra.

It will be understood that, in all cases, extreme limits for the alloy compositions of this invention constitute the ordinate axis, Ti = 0.05% and the maxima titanium = 2.2 weight per cent and aluminum = 5.0 weight per cent, a condition which is especially in point for those plots, such as FIG. 1(E) through (J), FIG. 2(A)

through (J) and certain of the others, where the individual curves run out of the overall plot sights without intersecting one or the other of the axes.

Related disclosures and claims are contained in applications Serial Nos. 707,350 Jan. 26, 1968, and 34,166 May 4, 1970 by applicant's associates, both supra. In these applications several samples containing 35% chromium and small quantities of aluminum are disclosed, with C+N contents less than 100 ppm, and these form the basis for certain claims in those applications. In order to avoid these disclosures and claims, applicant specifically disclaims all alloys containing less than 0.05% Ti on either the as charged or as analyzed bases.

II. Alloy Preparation and Testing for the sixty-one Older Samples

All test specimens were prepared according to the following general technique:

1. Charge

Carbon and nitrogen contents are preselected through addition of carbon as high-purity graphite and nitrogen as $Cr_2N$, a typical graphite analyzing 99.7 wt. per cent C and 50 ppm N, whereas a typical $Cr_2N$ contained 2228 ppm C and 11.1 wt. per cent N.

Three different sources of chromium were utilized interchangeably, these being:

| | C (ppm) | N (ppm) |
|---|---|---|
| VMG (Vacuum Melting Grade) | 160 | 72 |
| HP (High Purity Grade) | 16 | 7 |
| Ferrochromium (70%) | 250 | 945 |

Iron was furnished by Plast-Iron Grade A 101 (manufactured by the Glidden Company), a typical analysis for which is: C 16 ppm, N 43 ppm, Mn 0.002 wt. per cent, Si 0.005 wt. per cent, S 0.004 wt. per cent and P 0.005 wt. per cent.

Commercial practice permits the inclusion of up to about 1.5 wt. per cent Mn, which is said to improve hot workability, and up to about 1.0 wt. per cent Si, which serves as a deoxidizer. In order to duplicate this practice, Mn and Si were deliberately added in the amounts hereinafter detailed; however, as a matter of incidental interest, no particular benefits were discernible therefrom over other specimens substantially devoid of these ingredients.

Titanium was added as the high purity sponge or powder containing, typically, C 48 ppm and N 23 ppm.

The individual buttons were subjected to a minimum of three and a maximum of five remelts, the buttons being flipped over each time to improve the homogeneity.

Typical analyses of the finished buttons were as follows:

(a) Specimen Alloy No. 124

| Weights (in Grams) of Raw Materials | | Wt. Per Cent analysis | |
|---|---|---|---|
| 186 | VMG Cr | 30.3 | Cr |
| 399 | Plast-Iron | 1.39 | Mn |
| 9 | Mn | 0.92 | Si |
| 9 | Si | 0.016 | S |
| 0.85 | $Cr_2N$ | 0.018 | P |
| 0.12 | C | 0.0142 | C |
| | | 0.0220 | N |

(b) Specimen Sample No. 200 A

-continued

| Weights (in Grams) of Raw Materials | | Wt. Per Cent Analysis | |
|---|---|---|---|
| 184 | VMG Cr | 0.92 | Ti |
| 392 | Plast-Iron | 0.0439 | C |
| 9 | Mn | 0.0219 | N |
| 6 | Si | | |
| 6.6 | Ti | | |
| 3.0 | $Cr_2N$ | | |
| 0.26 | C | | |

2. Melting and Processing

Alloys of varying carbon plus nitrogen, chromium and titanium contents were made as 600-gram buttons by arc melting in a Heraeus furnace utilizing a "skull" melting technique employing a water-cooled copper crucible with heating accomplished under reduced helium pressure by an arc maintained between the charge and a tungsten electrode disposed near the top center of the charge, so that the melt was effectively insulated against pick up of metal from the crucible walls.

The buttons were individually hot-rolled at 2000°–2200° F. to a thickness of about 100 mils, after which the resulting sheets were annealed for 30 minutes at 850° C. and then water quenched.

3. Welding

Weld test samples measured approximately 3 inches long × 1 inch wide by 0.1 inch thick, and these were subjected to a welding process as follows:

A fusion weld was made on a piece of the alloy using the standard gas-tungsten arc welding process and an energy input per pass of approximately 16,000 joules/in. (the energy input per pass in joules/inch = arc voltage (volts) × arc current (amperes)/torch travel speed, in./sec.). In further explanation, there was no joinder of two pieces of alloy here, the electrode simply being given a single pass longitudinally of the sample piece. During this pass, the energy input was sufficient to melt the metal in the immediate region of the electrode traverse for the entire thickness of the sample and for a width of approximately 3/16 inch. The specimens were then allowed to cool in the air to room temperature, thereby duplicating usual welding practice.

4. Testing (a) Bending

The cooled material was then evaluated for post-weld ductility by bending, or attempting to bend, the individual flat welded samples through angles of 180° along a line transverse the weld axis according to the standard guided bend test provided in the ASME Pressure Vessel Code, 1965, Section IX, Page 59, using a plunger having a radius of 250 mils, so that the ratio of bend radius to sample thickness was 2.5.

A given alloy was appraised as ductile if it passed the bend test at room temperature without any visual evidence of cracking. Either two or four individual samples were welded and tested for each composition.

(b) Intergranular Corrosion Test

Corrosion test coupons were removed from the unstressed ends of the welded samples, given an 80-grit wet-belt finish and then subjected to the corrosion test (ASTM A262-64T, 1965 Book of Standards, pg. 217–239, which consists of immersion in boiling 50% $H_2SO_4$ containing 41.6g/l of ferric sulfate as inhibitor in repeated cycles of 24 hours duration up to a total exposure of 120 hours). Individual samples were rinsed, dried, and weighed after each 24-hour acid immersion and the corrosion rate determined. A ratio of welded specimen corrosion rate to annealed specimen corrosion rate (determined on the basis of the 120 hour exposure) not exceeding 2.0–2.5 was considered passing. In addition, the samples, particularly in the weld areas, were examined visually for signs of corrosion, as demonstrated by grain dislodgement or crevicing preliminary thereto, and specimens were rejected if there existed any significant attack of this nature.

My corrosion testing showed the following absolute corrosion rate in milli inches/year:

| Cr Level Wt.% | Corrosion Rate on Annealed Samples | Acceptable Rates on Welded Samples at 120 Hrs. (Equal to 2–2.5 Times Rates on Annealed Samples) Range | Mid-Range |
|---|---|---|---|
| 30 | 14–17 | 28–43 | 35 |
| 32 | 9–12 | 18–30 | 24 |
| 35 | 6–8 | 15–20 | |

(c) Experimental Results

Table III presents a tabulation of the experimental results for samples containing at least 28% chromium.

TABLE III

TITANIUM-CONTAINING SAMPLES FROM ASN 886620 (9/19/69); ALUMINUM-CONTAINING SAMPLES FROM ASN 34166 (5/4/70) AND SAMPLES CONTAINING NEITHER ALUMINUM NOR TITANIUM FROM ASN 1781 (1/9/70)

| Alloy No. | Wt. % Ti | Wt. % Al | ppm C | ppm N | ppm C+N | Postweld Properties* Corrosion Resistance | Postweld Properties* Ductility |
|---|---|---|---|---|---|---|---|
| | | | | | | (D = Ductile as welded B = Brittle as welded) | |
| | | | 28% Chromium Level | | | | |
| 394** | 0 | 0 | 49 | 12 | 61 | Good | 1D |
| 458 | 0 | 0 | 14 | 20 | 74 | Good | 1D |
| 443 | 0 | 0 | 40 | 74 | 113 | Good | 2D/1B |
| 395 | 0 | 0 | 14 | 123 | 137 | Poor | 1D/2B |
| 441 | 0 | 0 | 25 | 487 | 512 | Poor | 1B |
| **Alloy Nos. 456 and 457, with C+N<61, behaved similarity. | | | | | | | |
| | | | 30% Chromium Level | | | | |
| 187 | 0.25 | 0 | 53 | 74 | 127 | Good | D |
| 190 | 0.51 | 0 | 30 | 65 | 95 | Good | D |
| 333 | 0.52 | 0 | 53 | 151 | 204 | Good | 1D/2B |
| 191 | 0.52 | 0 | 103 | 151 | 254 | Good | 1D/2B |
| 233 | 0.70 | 0 | 70 | 255 | 325 | Good | D |
| 151 | 0.59 | 0 | 79 | 342 | 421 | Good | 1D/2B |
| 192 | 0.48 | 0 | 190 | 215 | 425 | Good | D |
| 127 | 0.47 | 0 | 193 | 295 | 488 | Good | D |
| 200A | 0.92 | 0 | 439 | 219 | 658 | Good | D |
| 122 | 0 | 0 | 27 | 75 | 102 | Good | 1D/1B |
| 126 | 0 | 0 | 49 | 195 | 244 | Poor | B |
| 130 | 0 | 0 | 150 | 300 | 450 | Poor | B |
| 415 | 0 | 0.2 | 5 | 18 | 23 | Good | 2D/1B |
| 416 | 0 | 0.5 | 7 | 5 | 12 | Good | 3D |
| 417 | 0 | 1.0 | 5 | 61 | 66 | Good | 3D |
| 418 | 0 | 2.0 | 6 | 279 | 285 | Good | 3D |
| 256 | 0 | 0 | 250 | 55 | 311 | Poor | B |
| 124 | 0 | 0 | 142 | 220 | 362 | Poor | B |
| 189 | 0.24 | 0 | 98 | 263 | 361 | Poor | D |
| 188 | 0.24 | 0 | 101 | 286 | 387 | Poor | B |
| 268 | 0.50 | 0 | 47 | 499 | 546 | Good | B |
| 193 | 0.47 | 0 | 448 | 272 | 720 | Poor | B |
| 194 | 0.44 | 0 | 622 | 376 | 998 | Poor | D |
| 246 | 0.70 | 0 | 535 | 670 | 1205 | Poor | B |
| 230 | 0.80 | 0 | 550 | 374 | 924 | Good | B |
| 253 | 1.0 | 0 | 463 | 450 | 913 | Poor | B |
| 199A | 0.96 | 0 | 213 | 316 | 529 | Good | B |
| | | | 32% Chromium Level | | | | |
| 271 | 0.05 | 0 | 47 | 34 | 81 | Good | D |
| 152 | 0.32 | 0 | 22 | 45 | 67 | Good | 1D,2B |
| 273 | 0.30 | 0 | 51 | 80 | 131 | Good | D |
| 209 | 0.21 | 0 | 116 | 236 | 352 | Good | D |
| 211 | 0.48 | 0 | 68 | 178 | 246 | Good | D |
| 212 | 0.48 | 0 | 139 | 247 | 386 | Good | D |
| 213 | 0.44 | 0 | 210 | 249 | 459 | Good | 1D,2B |
| 156 | 0.45 | 0 | 168 | 288 | 456 | Good | 1D,2B |
| 327 | 0.85 | 0 | 499 | 265 | 764 | Good | D |
| 334 | 0.01 | 0 | 50 | 30 | 80 | Good | B |
| 135** | 0 | 0 | 27 | 410 | 437 | Poor | B |
| 272 | 0.06 | 0 | 56 | 308 | 364 | Poor | B |
| 208 | 0.16 | 0 | 45 | 740 | 785 | Poor | B |
| 214 | 0.42 | 0 | 386 | 436 | 822 | Poor | 1D,2B |
| 157 | 0.46 | 0 | 632 | 408 | 1040 | Poor | D |
| 219 | 0.60 | 0 | 470 | 695 | 1165 | Poor | D |
| 217 | 1.0 | 0 | 173 | 595 | 768 | Fair | B |
| 216 | 0.80 | 0 | 56 | 389 | 445 | Good | B |
| 218 | 0.80 | 0 | 184 | 260 | 444 | Good | B |
| 258 | 0.90 | 0 | 45 | 69 | 114 | Good | B |
| 274 | 0.50 | 0 | 54 | 28 | 82 | Good | B |
| **Alloy Nos. 155, 167, 206, with 66<C+N<190, were also brittle. | | | | | | | |

TABLE III-continued

TITANIUM-CONTAINING SAMPLES FROM ASN 886620 (9/19/69); ALUMINUM-CONTAINING SAMPLES FROM ASN 34166 (5/4/70) AND SAMPLES CONTAINING NEITHER ALUMINUM NOR TITANIUM FROM ASN 1781 (1/9/70)

| Alloy No. | Wt. % Ti | Wt. % Al | ppm C | ppm N | C+N | Postweld Properties* Corrosion Resistance | Postweld Properties* Ductility |
|---|---|---|---|---|---|---|---|
| | | | 35% Chromium Level | | | | |
| 396** | 0 | 0 | 23 | 17 | 40 | Good | B |
| 399 | 0 | 0 | 23 | 155 | 178 | Good | B |
| 263 | 0.06 | 0 | 40 | 47 | 87 | Good | D |
| 266 | 0.30 | 0 | 23 | 212 | 235 | Good | D |
| 280 | 0.22 | 0 | 179 | 61 | 240 | Good | 1D,2B |
| 264 | 0.05 | 0 | 26 | 45 | 71 | Good | B |
| 330 | 0.02 | 0 | 59 | 116 | 175 | Poor | B |
| 331 | 0.10 | 0 | 63 | 114 | 207 | Good | B |
| 265 | 0.09 | 0 | 25 | 368 | 393 | Poor | B |
| 279 | 0 | 0 | 81 | 470 | 551 | Poor | B |
| 042-12 | 0 | 0.05 | 50 | 40 | 90 | Good | 1D,2B |
| 042-13 | 0 | 0.10 | 50 | 40 | 90 | — | D |
| 011-10 | 0 | 0.20 | 20 | 50 | 70 | — | D |
| 045-3 | 0 | 0.90 | 30 | 70 | 100 | — | D |
| 042-17 | 0 | 1.00 | 40 | 40 | 80 | Good | 1D,2B |
| 042-5 | 0 | 0.20 | −35 | 39 | 74 | Good | D,1B |
| 042-16 | 0 | 0.50 | 49 | 40 | 89 | Good | D |

**Alloy No. 444, C+N = 26 was also brittle.
*A dash (—) = not determined, or not listed.

In Table III are listed a series of samples that were prepared during the experimental work culminating in the three patent applications referenced in the Table heading. This tabulation is provided to establish a basis for the very small but important line of distinction in the lower left-hand corners of FIGS. 1A, 1'A', 1B, 1'B' 1C, 1C' and others. This line is there labelled "29–35 Cr". Alloys falling in the area to the right of this line and to the lower left (i.e., on the concave sides) of the other iso-chromium lines are ductile in the as-welded condition. However, materials falling to the lower left of this short line (i.e., inside the triangle) are mostly brittle in the as-welded condition like those on the convex side of the iso-chromium lines in the rest of FIGS. 1 and 1'.

The data for the establishment of this short line are partly those in Tables IIA and IIB for the corresponding levels of C+N, i.e., 139 ppm, 250 ppm, and 500 ppm, and partly the data in Table III. In the earlier experimental work the ductility tests were carried out on a good/no-good basis at 75° F. The samples were considered ductile if they bent when tested at this temperature. They were considered brittle if they broke at this temperature. The kind of test used was the same as has been previously described, but the testing was carried out only at the single 75° F. temperature. Accordingly, it was not possible to rate the ductility of these samples in terms of their brittle-ductile transition temperature and so they could not be merged with the data in Tables IIA and IIB for inclusion in the statistical analysis from which the correlating equations were prepared.

The same statement applies with respect to their corrosion resistance. They had been rated as "Good", "Fair", or "Poor". Good corresponds approximately to the corrosion rating of 2 or lower and Poor corresponds approximately to the corrosion rating of 3 or higher, with Fair falling between these numbers. For lack of individual numerical rating on corrosion, these data could not be merged with those from Tables IIa and IIB and included in the statistical correlations.

In FIG. 6 the data of Table III and from Table IIB have been plotted covering the three levels of C+N denoted, i.e., 139 ppm, 250 ppm and 500 ppm. The actual C+N values were put into the group of the next higher C+N rating and the three plots shown on FIG. 6 correspond with FIGS. 1A, 1'A', 1B, 1'B', 1C 1'C', 3'A' and 4'A', respectively. Upon careful review of these three plots it will be noted that samples containing 29 or more per cent chromium in general are ductile to the right side of the small line labelled "29–35 Cr" and brittle to the left of this line adjacent to the 0-0 Ti-Al coordinates. It will be noted, however, that at the lower C+N levels, when the Cr content was 28%, the samples were more often ductile than brittle.

The distribution of the ductility results shown in FIG. 6 is the basis for the establishment of the location of the lines labelled "29–35 Cr". Theoretically this line is an extension, with a very slight adjustment, of the corresponding curves from the equation; but there are insufficient data to put into the establishment of the coefficients for the equation to enable the curve from the equation to fall at this location. In other words, at this location applicant has overruled the statistical correlation very slightly in order to fit the facts. It is believed that this has been done without any significant disturbance to the meaning of the statistical correlation for the other areas of the analysis.

FIG. 6 shows a cross-hatch band extending along the aluminum axes of each of the three plots with a width of 0.05% Ti and extending out to the full limiting Al content of 5.0%. This prescription of a minimum Ti content of 0.05% effectively disclaims the coverage of Sipos et al. (application Ser. No. 34,166).

As hereinbefore mentioned, alloy compositions according to this invention were supplemented with molybdenum to determine if corrosion resistance could be thereby improved while still retaining good post-weld ductility. Very good results were obtained, as can be seen from the following comparative Table IV of ferritic alloys containing the same, or nearly the same, Cr, Ti, Al, C and N with added Mo (Alloy Nos. 528–530, 532 and 533) and their counterparts containing, however, no Mo (Alloy Nos. 519, 527 and 531).

TABLE IV

CORROSION RESISTANCE ON WROUGHT ANNEALED SAMPLES (EXCEPT SPECIMENS $A_1$ AND $A_2$)

| Sample No. | Wt. Per Cent Cr | Ti | Al | P.P.M. C | N | Boiling Acids 50% $H_2SO_4$ $Fe_2(SO_4)_3$ | 65% $HNO_3$ | 45% Formic | Pitting (1) ($FeCl_3$) | Stress Corrosion Cracking (Welded Samples) (45% $MgCl_2$) | Weld Bend Ductility |
|---|---|---|---|---|---|---|---|---|---|---|---|
| | | | | | | (3) | (mils/year) | | F = Failed — Not Tested | P = Passed | |
| A. ALLOYS OF Ti AND Al | | | | | | | | | | | |
| 527 | 20 | 0.9 | 0.4 | 400 | 400 | 58 | 15 | 10,000 (2) | F | P | P |
| 519 | 27 | 1.0 | 0.5 | 500 | 500 | 14 | 10 | 10,000 (2) | F | P | P |
| 531 | 31 | 0.9 | 0.4 | 400 | 400 | 10 | 4 | 1.7 | P | P | P |
| B. EFFECTS OF Mo ADDITIONS | | | | | | | | | | | |
| | Mo | | | | | | | | | | |
| 528 | 2.0 | 20 | 0.9 | 0.4 | 400 | 400 | 52 | 13 | 86* | F | P | P |
| 532 | 1.0 | 27 | 0.9 | 0.4 | 400 | 400 | 14 | 8 | 1.1* | P* | P | P |
| 529 | 2.0 | 27 | 0.9 | 0.4 | 400 | 400 | 14 | 10 | 0.6* | P* | — | F |
| 533 | 1.0 | 31 | 0.9 | 0.4 | 400 | 400 | 11 | 8 | 2.8 | P | P | P |
| 530 | 2.0 | 31 | 0.9 | 0.4 | 400 | 400 | 12 | 10 | 1.0 | P | — | F |
| $A_1$ | 1.0 | 26 | 1.0 | 0.30 | 400 | 300 | no attack | | welded samples | | P | P |
| $A_2$ (Commercial) | 1.0 | 26 | (none added | | 20 | 100 | failed | | | | F | P |

(1) 10% $FeCl_3$, Room Temp., No Crevice, "Passed" — No Failure after 10 Days of Exposure.
(2) $H_2$ gas copiously evolved.
(3) Regular intergranular attack test, described in Section 4(c).
*Contrast with similar samples above containing no Mo.

As shown by Table IV, the addition of only two weight per cent of Mo to a 20% Cr ferritic alloy (No. 528) vastly improved its resistance to 45% formic acid over its counterpart No. 527 without Mo; however, the pitting resistance was not improved.

A much greater relative improvement was achieved by only one weight per cent Mo addition to a 27% Cr ferritic alloy (No. 532) as regards both 45% formic acid corrosion resistance and pitting resistance to $FeCl_3$, the counterpart Alloy No. 519, without Mo, failing both of these tests. [It is true that the Ti, Al, C and N contents of these two Alloys are not identical; however, the slight excess in C+N constituting only 200 ppm for Alloy No. 519 ought to be more than compensated by the No. 519 alloy excess Ti (0.1%) and Al (0.1%).]

However, Mo content is relatively critical, and even two weight per cent in accompaniment with 27% and 31% Cr, respectively, caused failure in the weld bend tests for Alloy Nos. 529 and 530.

Accordingly, it is concluded that the optimum analyses incorporating Mo probably lie in the compositions according to this invention which fall in the ranges 20–32% Cr, 0–1.5% Mo, 0.6–1.2% Ti, 0.05–0.5% Al, 0–1000 ppm C+N, and the balance iron and incidental impurities.

There exists a commercial 1% Mo-containing ferritic alloy having 26% chromium content (Alloy $A_2$, Table III), a specimen of which was analyzed and found to contain only 20 ppm C and 100 ppm N, which are very low levels of each, necessitating extra care to achieve. This alloy failed the intergranular corrosion test as well as the stress corrosion test. In contrast, applicant's ferritic Alloy $A_1$, containing 1.0 wt. per cent Mo, 26% Cr, to which, however, was added 1.0% Ti and 0.3% Al, survived both the intergranular and the stress corrosion tests, even under the handicap of 400 ppm C and 300 ppm N. From this, it is seen that small Ti, Al additions serve to greatly enlarge the tolerance of Mo-modified Cr-containing ferritic alloys for both C and N, correspondingly simplifying the manufacturing practice.

It will be understood that curves are "closed" within the meaning intended by the claims for both of the situations where a single iso-chromium plot completes closure on itself and also where two equal value iso-chromium plots of applicable ductility and corrosion resistance intersect one another to define, within their joint confines, a closed area.

What is claimed is:

1. A ferritic stainless steel consisting essentially of, besides iron and incidental impurities, 19–35 weight per cent Cr, C and N collectively up to 0.28 weight per cent as charged (0.15 weight per cent as analyzed), and Al and Ti to levels giving compositions included within the areas bounded by the curves, on the concave sides thereof, the ordinate axis, Ti in weight per cent of 0.05 minimum and 2.2 maximum and Al = 5.0 weight per cent excluding, however, alloys containing 29–35 weight per cent Cr having a combined Al + Ti content below 0.1% total, of at least one of the group consisting of FIGS. 1, 1′, 2, 2′, 3, 3′, 4, 4′, 5 and 5′ where said curves are not closed, and within the areas bounded by said curves exclusively where said curves are closed, corresponding values of Al and Ti for intervening Cr contents being determined, to a close approximation, by linear interpolation along normals drawn from either of any one of any given pair of adjacent curves towards the other of said given pair of adjacent curves and for intervening C+N contents being determined, to a close approximation, by linear interpolation from the ordinate and abscissa axes of a given pair of adjacent plots for a preselected iso-chromium value.

2. A ferritic stainless steel according to claim 1 wherein said Al and Ti are each at levels giving compositions included within the areas bounded by the curves, on the concave sides thereof, the ordinate axis, Ti in the range of 0.05 to 2.2 weight per cent and Al = 5.0 weight per cent of one of the group consisting of FIGS. 3 and 3′ where said curves are not closed, and within the areas bounded by said curves exclusively where said curves are closed, corresponding values of Al and Ti for intervening Cr contents being determined, to a close approximation, by linear interpolation along normals drawn from either of any one of any given pair of adjacent curves towards the other of said given pair of adjacent curves and for intervening C+N contents being determined, to a close approximation, by linear ineterpolation from the ordinate and abscissa axes of a given pair of adjacent plots for a preselected iso-chromium value.

3. A ferritic stainless steel according to claim 1 wherein said Al and Ti contents are each at levels giving compositions included within the areas bounded by the curves, on the concave sides thereof, the ordinate axis, Ti in the range of 0.05 to 2.2 weight per cent and Al = 5.0 weight per cent of one of the group consisting of FIGS. 5 and 5' where said curves are not closed, and within the areas bounded by said curves exclusively where said curves are closed, corresponding values of Al and Ti for intervening Cr contents being determined, to a close approximation, by linear interpolation along normals drawn from either one of any given pair of adjacent curves towards the other of said given pair of adjacent curves and for intervening C+N contents being determined, to a close approximation, by linear interpolation from the ordinate and abscissa axes of a given pair of adjacent plots for a preselected iso-chromium value.

4. A ferritic stainless steel according to claim 1 consisting essentially of 20–32% Cr, up to 1.5% Mo, 0.6–1.2% Ti, up to 0.5% Al, up to 1000 ppm C+N as charged and the balance iron and incidental impurities.

5. A ferritic stainless steel according to claim 1 consisting essentially of 25–29% Cr, up to 1.5% Mo, 0.9–1.5% Ti, up to 1.5% Al (the Ti + Al aggregating no more than about 2.5% collectively), C plus N up to about 750 ppm as charged, and the balance iron plus incidental impurities.

6. A ferritic stainless steel according to claim 1 consisting essentially of 25–29% Cr, up to 1.5% Mo, 0.75–1.4% Ti, up to 1.5% Al (the Ti + Al aggregating no more than about 2.4% collectively), C plus N up to about 500 ppm as charged, and the balance iron plus incidental impurities.

7. A ferritic stainless steel consisting essentially of, besides iron and incidental impurities, 19–35 weight per cent Cr, C and N collectively up to 0.28 weight per cent as charged (0.15 weight per cent as analyzed), Ti 0.05 weight per cent minimum to 2.2 weight per cent maximum, Al up to 5.0 weight per cent (excluding, however, alloys containing 29–35 weight per cent Cr having a combined Al + Ti content below 0.1% total) having compositions such that preselected values of Cr, C+N, Al and Ti when inserted in the following quadratic equation utilizing the applicable Regression Coefficients set forth in TABLE I for As Charged Compositions and TABLE I' for As Analyzed Compositions give (1) Brittle-Ductile Transition Temperatures of 75° F. maximum and (2) corrosion ratings for intergranular attack of 2.0 maximum:

$$y = b_0 + b_1x_1 + b_2x_2 + b_3x_3 + b_4x_4\ 30\ b_{12}x_1x_2 + b_{13}x_1x_3 + b_{14}x_1x_4 + b_{23}x_2x_3 + b_{24}x_2x_4 + b_{34}x_3x_4 + b_{11}(x_1)^2 + b_{22}(x_2)^2 + b_{33}(x_3)^2 + b_{44}(x_4)^2$$

in which $x_1$ = wt. % Cr $x_2$ = wt. % Ti $x_3$ = wt. % Al $x_4$ = ppm (C+N) and the regression coefficients $b_1$, $b_2$, etc. set forth in Tables I and I' supra, whereas $y$ = brittle-ductile transition temperature, in degrees F., on welded samples when the coefficients in the column headed "BDTT", i.e., Brittle-to-Ductile Transition Temperatures, are used in the equations, and $y$ = corrosion rating for intergranular attack (according to a system hereinbefore detailed in which a rating of above 2.0 is unsatisfactory performance) when the coefficients in the column headed "Corrosion" are used in the equations.

8. A ferritic stainless steel according to claim 1 consisting on the as-analyzed basis essentially of 25–27% Cr, 0.9–1.1% Mo, 200–500 ppm carbon, 100–300 ppm nitrogen, giving a C plus N total of 300–800 ppm, 0.35–1.4% Ti, up to 0.3% Al and the balance iron plus incidental impurities.

9. A ferritic stainless steel according to claim 1 consisting on the as-analyzed basis essentially of 20–32% Cr, up to 1.5% Mo, 0.6–1.0% Ti, up to 0.5% Al, up to 750 ppm C plus N and the balance iron and incidental impurities.

10. A ferritic stainless steel according to claim 1 consisting on the as-analyzed basis essentially of 25–29% Cr, up to 1.5% Mo, 0.8–1.1% Ti, up to 0.7% Al (the Ti plus Al aggregating no more than about 1.5% collectively), C plus N up to about 500 ppm, and the balance iron plus incidental impurities.

11. A ferritic stainless steel according to claim 1 containing, additionally, up to 1.5% Mo.

* * * * *

UNITED STATES PATENT OFFICE

CERTIFICATE OF CORRECTION

PATENT NO. : 3,992,198

DATED : November 16, 1976 Page 1 of 11

INVENTOR(S) : JOSEPH J. DEMO, JR.

It is certified that error appears in the above-identified patent and that said Letters Patent are hereby corrected as shown below:

Col. 1, line 26, "2.2." should read --2.2--
2, line 9, "Ti=to 0," should read --Ti=0,--
3, line 35, "researchd" should read --research--
4, line 3, should read --"as charged"--; --"as analyzed"--
4, lines 20-21, "quantities" should be --qualities--
4, line 37, "concerned" should read --concerning--
4, line 67, "=" should read --+--
7, line 28, Line 28 omitted, should read --up to 500 ppm C+N, as charged-- before the line "and the balance being iron and the usual impurities."
9, line 39, "-25°OF." should read -- -25°F.--
10, line 31, "no lead" should read --not lead--
11, line 59, should read --"predicted"--
17, line 48, "FIGS. 11A" should read --FIGS. 1A--
18, line 26, "percent", first occurrence, should read --percents--
19, line 21, "are" should read --were--
22, line 9, --17-- left out of table, third numeral, fourth column
22, last line "<190" should read --≤190--
23, lines 60, 61, quotes "Good" and "Poor" omitted
23, line 63, quotes "Fair" omitted
23, line 65 "IIa" should be --IIA--
25-26 (approx) should have line between brackets and
1, 20-21) "welded samples" both sides
28, line 10 Delete "30" and insert --+--

UNITED STATES PATENT OFFICE

CERTIFICATE OF CORRECTION

Patent No. 3,992,198 Dated November 16, 1976

Inventor(s) JOSEPH J. DEMO, JR. Page 2 of 11

It is certified that error appears in the above-identified patent and that said Letters Patent are hereby corrected as shown below:

FIGS. 1'A' to 1'H', 2'A' to 2'H', 3'A' to 3'H', 4'A' to 4'H' and 5'A' to 5'C', a total of nine sheets of drawings, should appear as shown on the attached sheets.

Signed and Sealed this

Fifth Day of April 1977

[SEAL]

*Attest:*

RUTH C. MASON
*Attesting Officer*

C. MARSHALL DANN
*Commissioner of Patents and Trademarks*

AS ANALYZED

ISO-CHROMIUM PLOTS DEFINING ALLOYS HAVING POST-WELD DUCTILITY AT, OR BELOW, ROOM TEMPERATURE (75°) AT RECITED C+N LEVELS IN P.P.M.

AS ANALYZED

ISO-CHROMIUM PLOTS DEFINING ALLOYS HAVING POST-WELD DUCTILITY AT, OR BELOW, ROOM TEMPERATURE (75°) AT RECITED C+N LEVELS IN P.P.M.

AS ANALYZED

ISO-CHROMIUM PLOTS DEFINING ALLOYS HAVING POST-WELD CORROSION RESISTANCE AT RECITED C+N LEVELS IN P.P.M.

AS ANALYZED

ISO-CHROMIUM PLOTS DEFINING ALLOYS HAVING POST WELD CORROSION RESISTANCE AT RECITED C+N LEVELS IN P.P.M.

AS ANALYZED

ISO-CHROMIUM PLOTS DEFINING ALLOYS HAVING BOTH POST-WELD DUCTILITY AT, OR BELOW, ROOM TEMPERATURE (75°F) AND CORROSION RESISTANCE AT RECITED C+N LEVELS IN P.P.M.

AS ANALYZED

ISO-CHROMIUM PLOTS DEFINING ALLOYS HAVING BOTH POST-WELD DUCTILITY AT, OR BELOW, ROOM TEMPERATURE (75°F.) AND CORROSION RESISTANCE AT RECITED C+N LEVELS IN P.P.M.

AS ANALYZED

ISO-CHROMIUM PLOTS DEFINING ALLOYS HAVING POST-WELD DUCTILITY AT, OR BELOW, 0°F. AT RECITED C+N LEVELS IN P.P.M.

AS ANALYZED

ISO-CHROMIUM PLOTS DEFINING ALLOYS HAVING POST-WELD DUCTILITY AT, OR BELOW, 0°F. AT RECITED C+N LEVELS IN P.P.M.

AS ANALYZED

ISO-CHROMIUM PLOTS DEFINING ALLOY HAVING BOTH POST-WELD DUCTILITY AT, OR BELOW, 0°F. AND CORROSION RESISTANCE AT RECITED C+N LEVELS IN P.P.M.

UNITED STATES PATENT OFFICE

CERTIFICATE OF CORRECTION

Patent No. 3,992,198 Dated November 16, 1976

Inventor(s) Joseph J. Demo, Jr.

It is certified that error appears in the above-identified patent and that said Letters Patent are hereby corrected as shown below:

Figures 2'C', 2'D' and 3'D' thru 3'H' should appear as per attachments.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*

AS ANALYZED

ISO-CHROMIUM PLOTS DEFINING ALLOYS HAVING BOTH POST-WELD DUCTILITY AT, OR BELOW, ROOM TEMPERATURE (75°F) AND CORROSION RESISTANCE AT RECITED C+N LEVELS IN P.P.M.

AS ANALYZED

ISO-CHROMIUM PLOTS DEFINING ALLOYS HAVING BOTH POST-WELD DUCTILITY AT, OR BELOW, ROOM TEMPERATURE (75°F.) AND CORROSION RESISTANCE AT RECITED C+N LEVELS IN P.P.M.